US006154231A

United States Patent [19]

Iwata

[11] Patent Number: 6,154,231

[45] **Date of Patent: *Nov. 28, 2000**

[54] SUCTION RECOVERY OF INK JET RECORDING APPARATUS

[75] Inventor: Kazuya Iwata, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/319,711

[22] Filed: Oct. 7, 1994

Related U.S. Application Data

[62] Division of application No. 08/208,087, Mar. 9, 1994, which is a continuation of application No. 07/762,362, Sep. 19, 1991, abandoned.

[30] Foreign Application Priority Data

| | | | |
|---|---|---|---|
| Sep. 19, 1990 | [JP] | Japan | 2-251453 |
| Sep. 25, 1990 | [JP] | Japan | 2-254641 |
| Sep. 25, 1990 | [JP] | Japan | 2-255942 |

[51] Int. Cl.[7] ..... B41J 2/165

[52] U.S. Cl. ..... 347/30; 347/23

[58] Field of Search ..... 347/30, 29, 32, 347/36

[56] References Cited

U.S. PATENT DOCUMENTS

| | | | |
|---|---|---|---|
| 4,123,761 | 10/1978 | Kimura et al. | 347/30 |
| 4,313,124 | 1/1982 | Hara | 347/57 |
| 4,345,262 | 8/1982 | Shirato et al. | 347/10 |
| 4,380,770 | 4/1983 | Maruyama | 347/29 |
| 4,383,263 | 5/1983 | Ozawa et al. | 347/30 |
| 4,394,669 | 7/1983 | Ozawa et al. | 347/86 |
| 4,403,233 | 9/1983 | Terasawa et al. | 347/30 |
| 4,410,900 | 10/1983 | Terasawa | 347/30 |
| 4,459,600 | 7/1984 | Sato et al. | 347/47 |
| 4,463,359 | 7/1984 | Ayata et al. | 347/56 |
| 4,492,969 | 1/1985 | Terasawa | 347/30 |
| 4,518,973 | 5/1985 | Tazaki | 347/30 |

(List continued on next page.)

FOREIGN PATENT DOCUMENTS

| | | | |
|---|---|---|---|
| 0362897 | 4/1990 | European Pat. Off. . | |
| 375407 | 6/1990 | European Pat. Off. . | |
| 3633239 | 4/1987 | Germany . | |
| 54-56847 | 5/1979 | Japan . | |
| 31165 | 2/1984 | Japan | 347/30 |
| 59-123670 | 7/1984 | Japan . | |
| 59-138461 | 8/1984 | Japan . | |
| 60-71260 | 4/1985 | Japan . | |
| 104336 | 6/1985 | Japan | 347/30 |
| 60-178063 | 9/1985 | Japan . | |
| 62-077940 | 4/1987 | Japan . | |
| 62-212155 | 9/1987 | Japan . | |

*Primary Examiner*—John Barlow
*Assistant Examiner*—Craig A. Hallacher
*Attorney, Agent, or Firm*—Fitzpatrick, Cella, Harper and Scinto

[57] ABSTRACT

An ink jet apparatus has a sucking device for sucking ink from a cap, and this sucking device includes a sucking space formed by a cylinder and piston adapted to the cylinder, wherein an internal pressure variation in the sucking space varies according to the mutual relation of the cylinder and piston. The sucking device has a suction opening for transmitting the internal pressure variation in the sucking space to a cap for covering an ink discharge opening of a recording head. A controller regulates the sucking means so that a stroke of the piston in the cylinder of an idle suction when the suction is performed in a state where the cap is opened to atmosphere is smaller than that of a true suction when the suction is performed in a state where the cap is closed to the atmosphere. The idle suction starts from a start point in which the piston and cylinder are disposed relative to each other such that the piston shuts the suction opening just after a start of the idle suction and advances toward a lower dead point of the cylinder.

19 Claims, 25 Drawing Sheets

U.S. PATENT DOCUMENTS

| | | | |
|---|---|---|---|
| 4,558,333 | 12/1985 | Sugitani et al. | 347/65 |
| 4,723,129 | 2/1988 | Endo et al. | 347/56 |
| 4,739,340 | 4/1988 | Terasawa | 347/30 |
| 4,740,796 | 4/1988 | Endo et al. | 347/56 |
| 4,745,414 | 5/1988 | Okamura et al. | 347/30 |
| 4,800,403 | 1/1989 | Accattino et al. | 347/30 |
| 4,847,637 | 7/1989 | Watanabe et al. | 347/30 |
| 4,967,204 | 10/1990 | Terasawa et al. | 347/23 |
| 5,164,748 | 11/1992 | Katayanagi et al. | 347/30 |
| 5,214,447 | 5/1993 | Iwata | 347/30 |
| 5,245,362 | 9/1993 | Iwata | 347/23 |
| 5,559,537 | 9/1996 | Terasawa | 347/30 |

| |
|---|
| FIG. 12A |
| FIG. 12B |

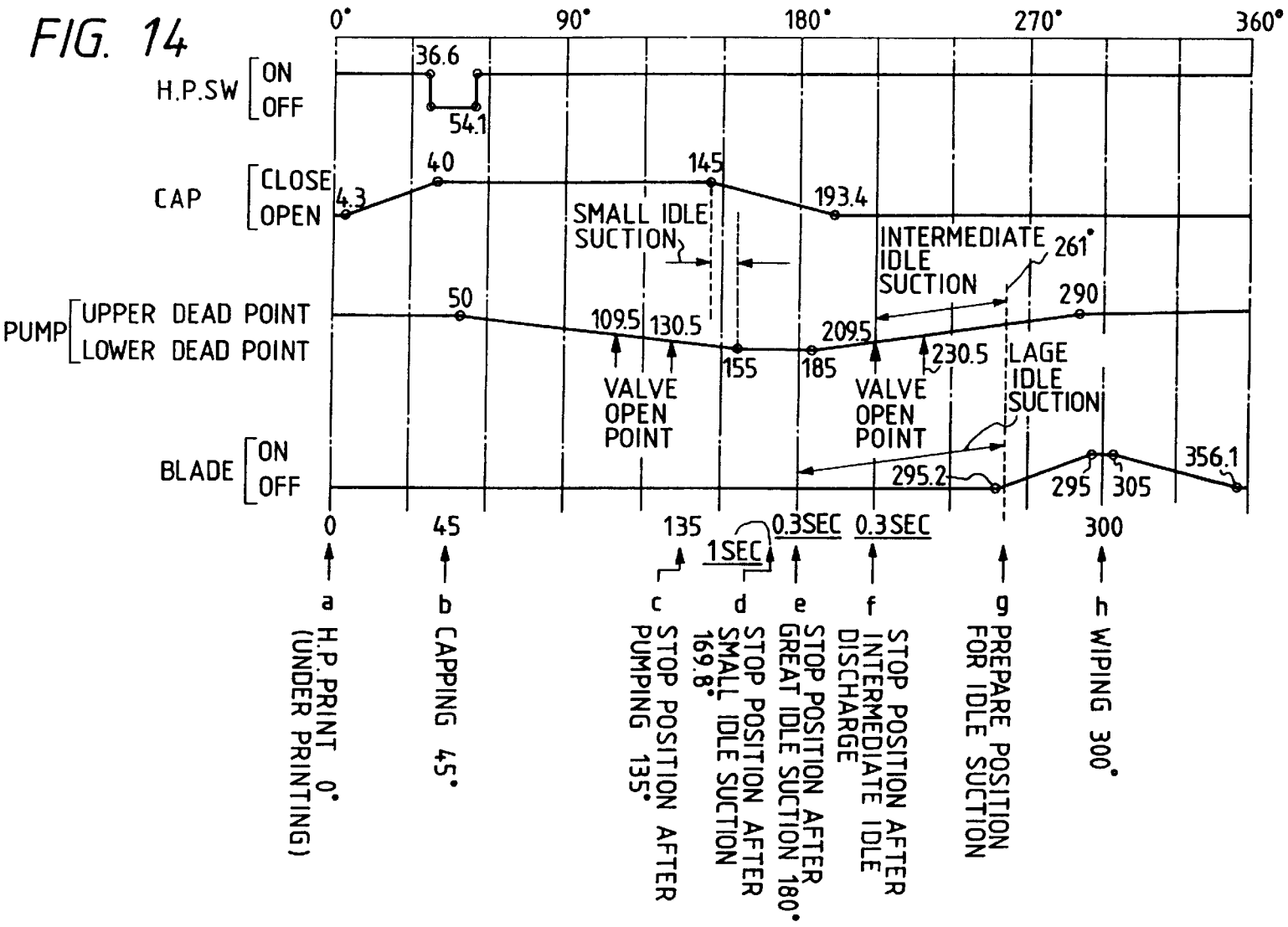
FIG. 14
H.P.SW
ON
OFF
CAP
CLOSE
OPEN
PUMP
UPPER DEAD POINT
LOWER DEAD POINT
BLADE
ON
OFF
0°
90°
180°
270°
360°
36.6
54.1
4.3
40
145
193.4
50
109.5
130.5
155
209.5
185
230.5
290
356.1
305
295
295.2
SMALL IDLE SUCTION
INTERMEDIATE IDLE SUCTION
261°
LAGE IDLE SUCTION
VALVE OPEN POINT
VALVE OPEN POINT
0
45
135
0.3SEC
0.3SEC
1SEC
300
a H.P.PRINT 0° (UNDER PRINTING)
b CAPPING 45°
c STOP POSITION AFTER PUMPING 135°
d STOP POSITION AFTER SMALL IDLE SUCTION 169.8°
e STOP POSITION AFTER GREAT IDLE SUCTION 180°
f STOP POSITION AFTER INTERMEDIATE IDLE DISCHARGE
g PREPARE POSITION FOR IDLE SUCTION
h WIPING 300°

| |
|---|
| FIG. 16A |
| FIG. 16B |

| | |
|---|---|
| FIG. 17A-1 | |
| FIG. 17A-2 | FIG. 17A-3 |

SUCTION RECOVERY OF INK JET RECORDING APPARATUS

This application is a division of application Ser. No. 08/208,087 filed Mar. 9, 1994, which in turn is a continuation of application Ser. No. 07/762,362 filed Sep. 19, 1991, now abandoned.

BACKGROUND OF THE INVENTION

1. Field of the Invention

The present invention relates to a suction recovery device for discharging liquid from a pump after it was sucked, and a recording system such as a copying machine, facsimile, computer, word processor and combinations thereof, having such a recovery device, and more particularly, it relates to an ink jet recording system wherein the suction recovery device of the above-mentioned type is applied to an ink receiving member such as a cap for receiving waste ink from a recording head.

2. Related Background Art

In the past, an ink jet recording system wherein an ink image is recorded on a recording medium such as a cloth, paper, OHP sheet and the like (referred to as "recording sheet" or merely as "sheet" hereinafter), a recording head having an array of minute or small discharge openings has been used. Therefore, when bubbles and/or dirt are entered into the discharge opening or openings or when the viscosity of ink is increased due to the vaporization of solvent in the ink, which lead to the poor ink discharge or poor recording, or before such a poor condition occurs, a treatment for removing the factors leading to the poor ink discharge (discharge recovery treatment) has been adopted.

Normally, a preliminary discharge operation for discharging the ink from the discharge openings (for example, toward a cap or ink absorbing sheet or sponge) without recording an image on a sheet or a suction recovery operation effected by a pump communicated with a cap to generate a suction force in the cap has been used as the discharge recovery treatment.

On the other hand, within the recording system, there is disposed a waste ink tank for collecting waste ink produced by the discharge recovery treatment. Further, an idle suction operation for sucking the ink together with air by activating the pump while communicating the cap with the atmosphere is also effected in order to direct the waste ink contained in the discharge recovery device including the cap, pump and an waste ink tube connecting them to each other to the waste ink tank. This idle suction operation is very effective to prevent the residual waste ink from being solidified or from leaking out of the cap if the waste ink produced by the discharge recovery treatment is left in the discharge recovery device.

Further, such a pump has been used not only to suck the waste ink but also to discharge normal liquids to predetermined positions in various applications.

However, the idle discharge operation was generally effected at a high speed to prevent the delay in the discharge recovery treatment, with the result that the liquid sucked by the pump tended to flow backwardly or reversely. This tendency is particularly noticeable when the pump has been used for a long time.

Similarly, even when the idle suction operation is effected by a discharge recovery mechanism wherein the interior arrangement within a cylinder thereof is simplified by omitting a normal check valve mechanism, the above-mentioned back flow frequently occurs. In addition, since the suction recovery mechanism requires a large installation space within the recording system, in order to make the recording system small-sized, it is needed to make the suction recovery device itself small-sized. However, the smaller the recovery device the more the above-mentioned back flow problem is serious. Thus, it has been recognized that it was important to solve this problem.

As mentioned, if the ink once sucked flows reversely, there arises a problem that the ink is scattered in bubble forms with air from the cap to adhere to a recording head opposed to the cap. The ink adhered to the recording head adversely affects an ink discharge condition. That is to say, the ink adhered to the discharge openings and therearound of the recording head pulls ink droplets discharged from the discharge openings, thus deviating the ink droplets from their normal paths.

Further, although a wiping operation is effected to remove the excessive ink droplets on the recording head during the discharge recovery treatment, if an amount of ink adhered to the recording head is great, a wiping blade is liable to become dirty easily, with the result that, when a large number of prints are continuously produced, the wiping ability is reduced, thus worsening the recording quality. Although it is considered that a special valve mechanism is provided for preventing the back flow of the bubble-form ink, there arises a drawback that the system is bulky and the cost thereof is increased. Further, when the ink flows reversely, the amount of the residual waste ink in the system increases. Under this condition, if the recording system is left for a long time, the waste ink will be solidified, thus resulting in the malfunction of the recovery device.

SUMMARY OF THE INVENTION

An object of the present invention is to provide an ink jet recording system and a recovery device used with such system, which can eliminate the above-mentioned conventional drawbacks caused by a back flow of ink in the recovery device of the ink jet recording system.

Another object of the present invention is to provide an ink jet recording system comprising an ink receiving member for receiving ink discharged from a recording head, an introducing means for directing the ink from the ink receiving member to a waste ink containing portion, and a control means for controlling a relative position between the recording head and the ink receiving member so that the ink receiving member is not disposed in confronting relation to the recording head during an introducing process effected by the introducing means.

A third object of the present invention is to provide an ink jet recording system comprising an ink receiving member for receiving ink discharging from a recording head, an introducing means for directing the ink from the ink receiving member to a waste ink containing portion, and a changing means for changing a relative position between the recording head and the ink receiving member from a confronting relation to a non-confronting relation by displacing at least one of the recording head and the ink receiving member during an operation of the introducing means.

A fourth object of the present invention is to provide an ink jet recording system comprising an ink receiving member for receiving ink discharged from a recording head, an introducing means for directing the ink from the ink receiving member to a waste ink containing portion, and a control means for controlling a relative position between the recording head and the ink receiving member so that the ink receiving member is not disposed in confronting relation to the recording head during an introducing process effected by the introducing means. The control means performs its control before the ink is scattered from the ink receiving member due to a back flow of the ink during the introducing process.

A fifth object of the present invention is to provide an ink jet recording system comprising an ink receiving member for receiving ink discharged from a recording head, an introducing means for directing the ink from the ink receiving member to a waste ink containing portion, and a control means for controlling at least one of the recording head and the ink receiving member so that the ink receiving member is not disposed in confronting relation to the recording head during an operation of the introducing means.

A sixth object of the present invention is to provide an ink jet recording system comprising an ink receiving member for receiving ink discharged from a recording head, a pump means for directing the ink from the ink receiving member to a waste ink containing portion, and a control means for controlling a relative position between the recording head and the ink receiving member so that the ink receiving member is not disposed in confronting relation to the recording head during an operation of the pump means. The pump means serves to suck the ink received in the ink receiving member to introduce the ink into a body of the pump means and further to direct the ink to the waste ink containing portion, by transmitting a negative pressure generated in the body of the pump means by a movement of a piston within the body of the pump means to the ink receiving member via a suction opening formed in the body of the pump means.

A seventh object of the present invention is to provide a suction recovery device comprising a suction pump having a piston and adapted to perform an idle suction for discharging sucked ink from the suction pump, wherein a stop time period is provided at an inversion position at a lower dead point of the piston for performing the idle suction.

An eighth object of the present invention is to provide a recording system comprising an ink jet recording head, the above-mentioned suction recovery device, and a cap mechanism attached to the suction recovery device and adapted for capping the recording head, wherein liquid used with the recording system is ink.

A ninth object of the present invention is to provide a suction recovery device comprising a suction pump having a piston and adapted to perform an idle discharge for discharging sucked ink from the suction pump via a suction opening, wherein an inversion position at an upper dead point of the piston for performing the idle discharge is a position where the suction opening is closed.

A tenth object of the present invention is to provide a recording system comprising a recording head, the above-mentioned suction recovery device, and a cap mechanism attached to the suction recovery device and adapted to for capping the recording head, wherein liquid used with the recording system is ink.

BRIEF DESCRIPTION OF THE DRAWINGS

FIG. 14 is a view showing cam profiles for driving a discharge recovery mechanism according to this embodiment;

DETAILED DESCRIPTION OF THE PREFERRED EMBODIMENTS

Figure 1:
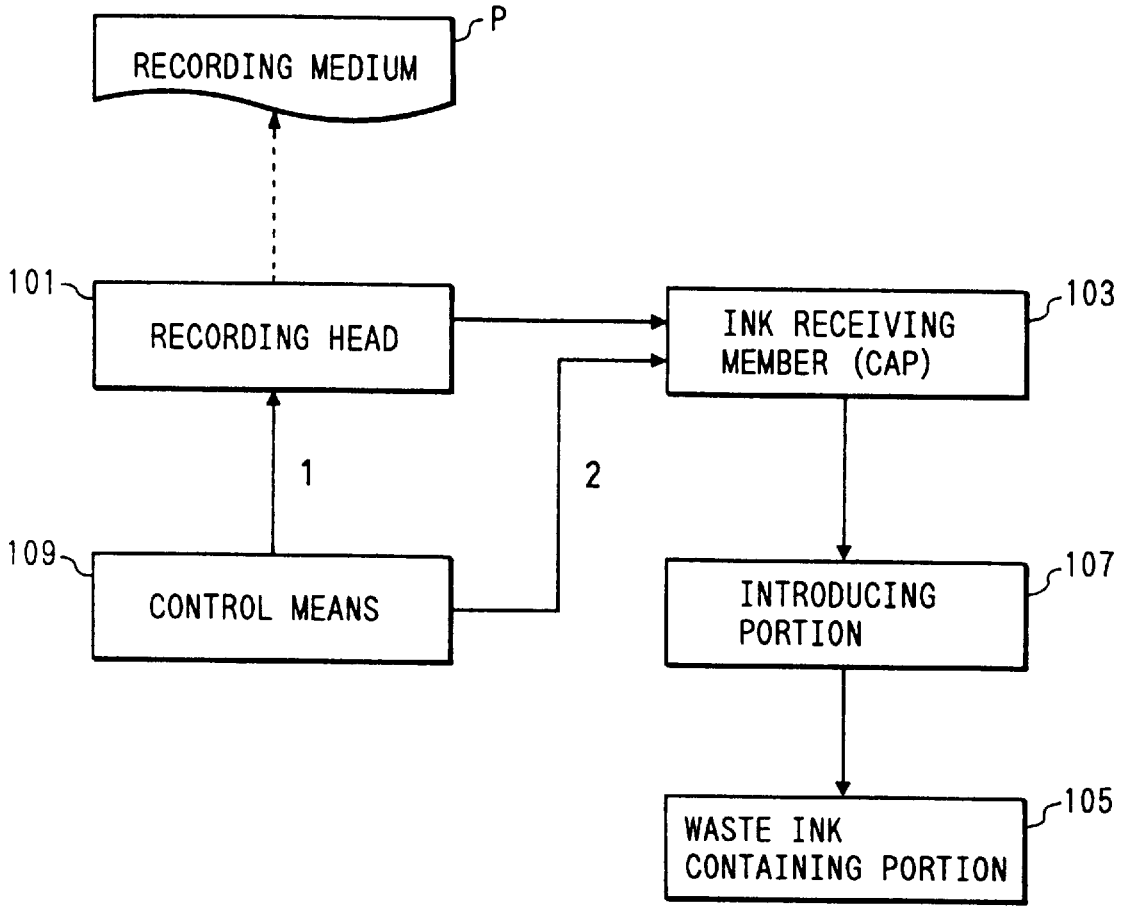
FIG. 1 is a schematic block diagram showing the whole construction of an ink jet recording system according to a preferred embodiment of the present invention.

A block diagram showing a schematic construction of an ink jet recording system according to a preferred embodiment is shown in FIG. 1.

According to this arrangement, there is provided a recording head 101 for discharging liquid (ink) toward a recording medium P; an ink receiving member 103 for receiving the ink discharged from the recording head 101; an introducing means 107 for directing the ink received by the ink receiving member to a waste ink containing portion 105; and a control means 109 for controlling at least one of the recording head 101 and the ink receiving member 103 so that the ink receiving member 103 is not disposed in confronting relation to the recording head 101 during an introducing process for directing the ink from the ink receiving member 103 by which the ink discharged from the recording head 101 is received to the waste ink containing portion 105. The control means 109 performs its control before the ink is scattered from the ink receiving member 103 due to a back flow of the ink.

In FIG. 1, an arrow designated by 1 shows a case where the control means 109 controls a positional relation between the recording head and the ink receiving member by shifting the recording head 101, while an arrow designated by an 2 shows a case where the control means 109 controls the positional relation between the recording head and the ink receiving member by shifting the ink receiving member 103. Incidentally, the control means 109 may control the positional relation between the recording head and the ink receiving member by shifting both of the recording head 101 and the ink receiving member 103.

According to this embodiment, since the control means is provided for controlling the relative position between the recording head and the ink receiving member so that the ink receiving member is not disposed in confronting relation to the recording head during the introducing process effected by the introducing means for directing the ink from the ink receiving member by which the ink discharged from the recording head is received to the waste ink containing portion, it is possible to prevent the excessive ink from adhering to the recording head, with an improved simple control of operation. Thus, since a good ink discharging condition of the recording head is always maintained and an amount of the ink adhered to the recording head can be reduced, the contamination of a blade is reduced during a wiping operation for removing the excessive ink on the recording head, with the result that, even when a large number of prints are continuously produced, the wiping ability is not reduced, thus improving the recording quality considerably.

Now, the preferred embodiment of the present invention will be fully explained with reference to the accompanying drawings.

Figure 2:
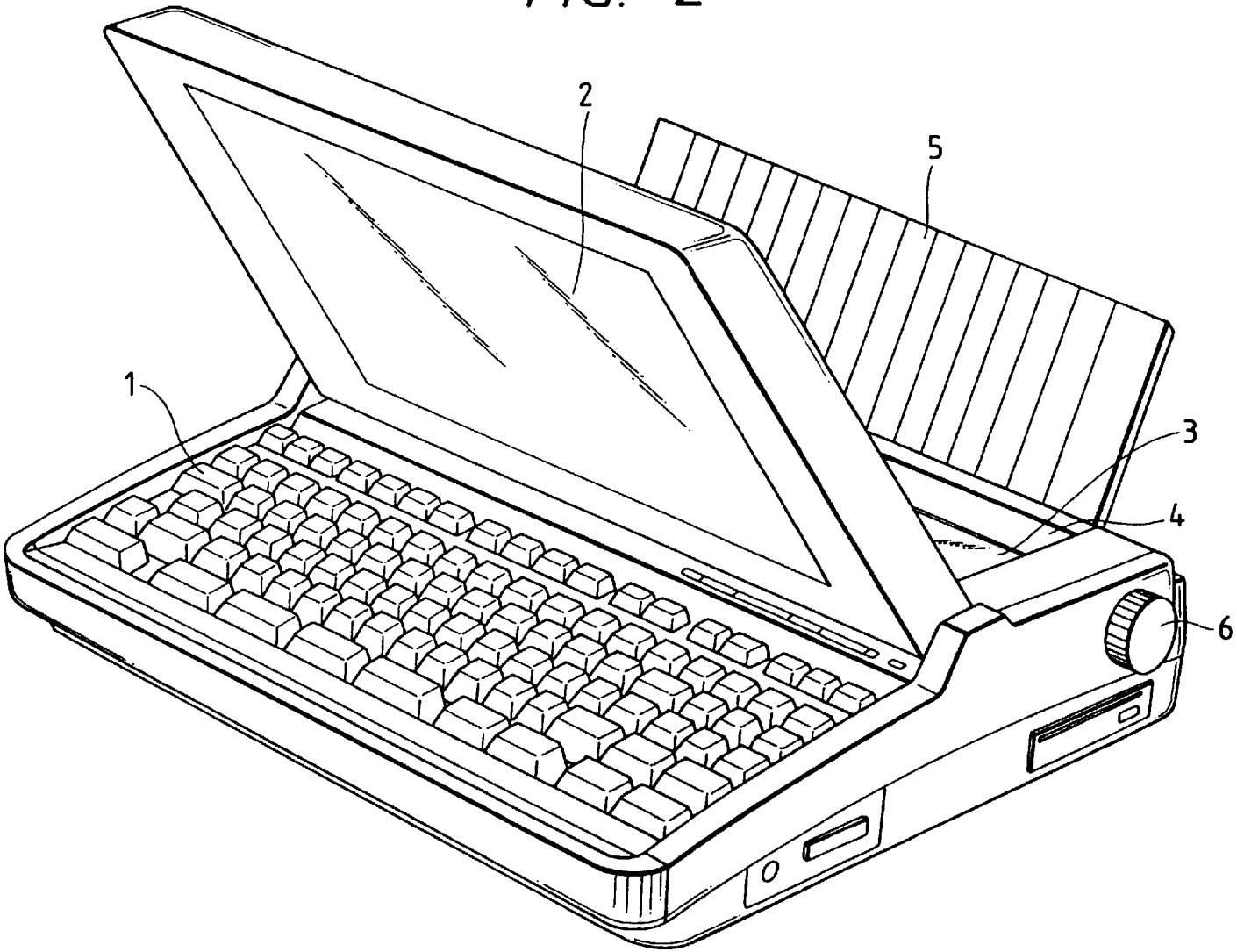
FIG. 2 is a perspective view of a word processor as an example of equipment to which the preferred embodiment of the present invention is applied.

FIG. 2 shows an appearance of a document forming apparatus (referred to as "word processor" hereinafter) to which the preferred embodiment of the present invention is applicable.

In FIG. 2, the word processor comprises a keyboard portion 1 acting as an input means, a display portion 2 for displaying sentences and the like inputted from the keyboard portion, which display portion is pivotally mounted on the word processor so that it can be closed to overlap with the keyboard portion 2 when it is not used, an openable transparent or semi-transparent protection cover 3 disposed at a viewing opening through which an operating condition of a recording head is ascertained, a spur cover 4 for holding spurs, a sheet supporter 5 for supporting a recording sheet during the ejection thereof, and a knob 6 for manually supplying and ejecting the recording sheet.

Figure 3:
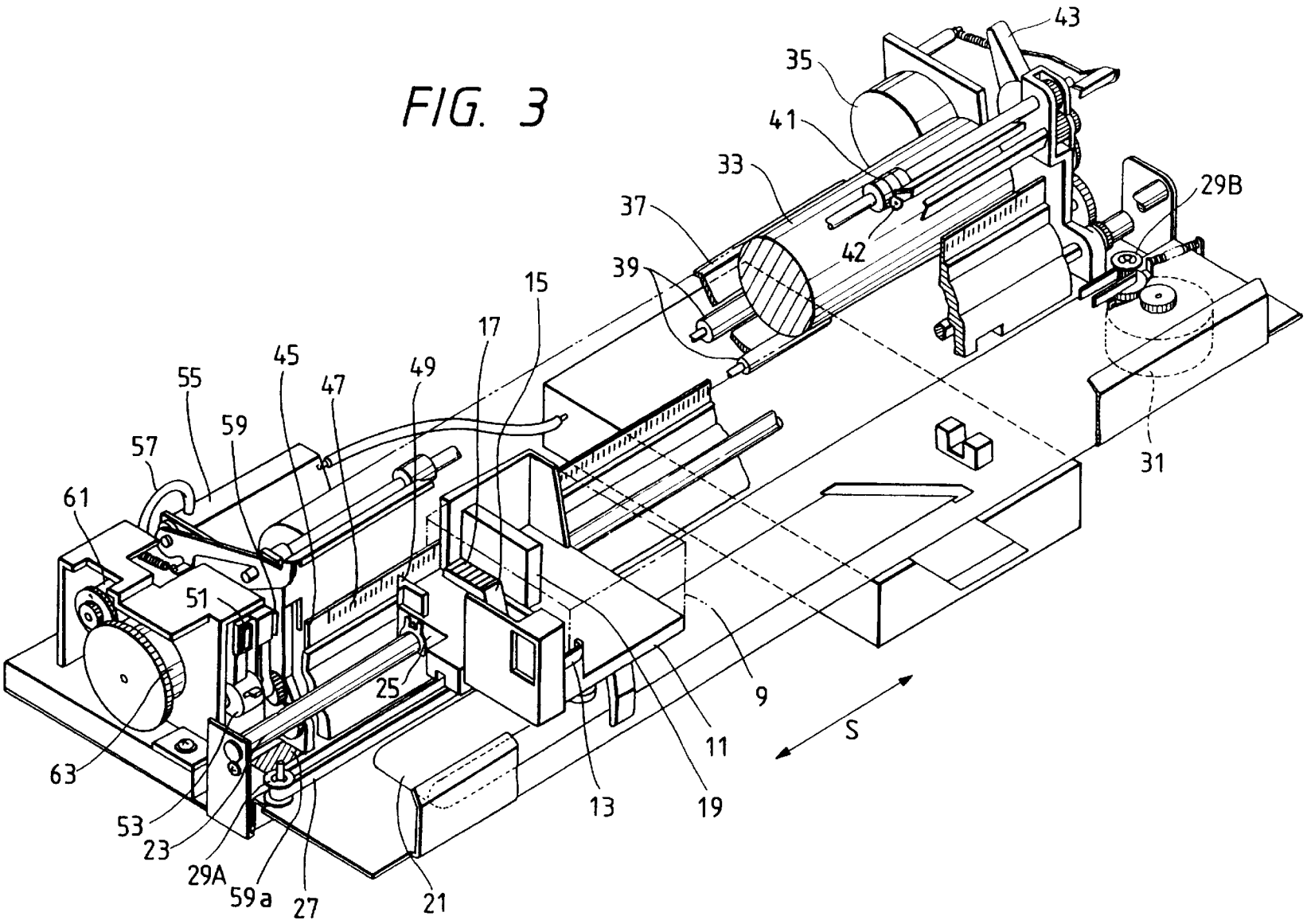
FIG. 3 is a perspective view showing an example of the ink jet recording system as a printer portion of the word processor.

FIG. 3 shows an example of a printer portion of the ink jet recording system according to this embodiment.

The reference numeral 9 denotes a head cartridge including an ink jet recording head; and 11 denotes a carriage on which the head cartridge 9 is mounted and which can be shifted in a direction S for a scanning operation. The reference numeral 13 denotes a hook for attaching the head cartridge 9 to the carriage 11; and 15 denotes a lever for driving the hook 13. A marker 17 formed on the lever 15 serves to indicate one of scales formed on a cover (described later) to permit the readings of a recording position and/or a setting position of the recording head of the head cartridge 9.

The reference numeral 19 denotes a support plate for supporting an electric connection portion to the head cartridge 9; and 21 denotes a flexible cable for connecting the electric connection portion to a control portion of the recording system. A guide shaft 23 serves to guide the carriage 11 in the direction S and is received in bearings 25 of the carriage 11. A timing belt 27 is entrained around pulleys 29A, 29B disposed on both ends of the system and serves to transmit a driving force to the carriage 11 to which the timing belt is connected, for shifting the carriage to the direction S. The driving force is transmitted from a carriage motor 31 to the pulley 29B via a transmission mechanism such as a gear train.

A platen roller 33 serves to regulate a non-recorded surface of a recording medium (referred to as "recording sheet" hereinafter) such as a paper and feed the recording sheet during a recording operation and is driven by a convey motor 35. The reference numeral 37 denotes a paper pan for directing the recording sheet from the sheet support 5 to a recording position; and 39 denotes feed rollers disposed in a recording sheet feeding path and adapted to feed the recording sheet while urging it against the platen roller 33. An ejector roller 41 is disposed at a downstream side of the recording position in the recording sheet feeding direction and serves to eject or discharge the recording sheet toward an ejection opening (not shown). A spur 42 disposed in confronting relation to the ejector roller 41 serves to urge the recording sheet against the ejector roller 41 to apply a feeding force of the ejector roller 41 to the recording sheet. A release lever 43 serves to release the biasing or urging forces of the feed rollers 39, a sheet hold-down plate 45 and the spur 42 for facilitating the setting of the recording sheet. The sheet hold-down plate 45 serves to suppress the floating of the recording sheet near the recording position, thus maintaining the close contact between the recording sheet and the platen roller 33.

In the illustrated embodiment, an ink jet recording head for recording an image on the recording sheet by discharging ink is used as the recording head. Thus, since a distance between a discharge opening forming surface of the recording head and a surface (to be recorded) of the recording sheet is relatively small and such distance must be severely controlled to prevent the recording sheet from contacting the discharge opening forming surface of the recording head, the provision of the sheet hold-down plate 45 is effective. The reference numeral 47 denotes a scale formed on the sheet hold-down plate 45; and 49 denotes a marker formed on the carriage 11 in association with the scale. Thus, also with the scale and marker, it is possible to read the recording position and/or the setting position of the recording head. A cap 51 made of elastic material such as rubber is disposed in confronting relation to the ink discharge opening forming surface of the recording head at a home position thereof and can be engaged by and disengaged from the recording head. The cap 51 is used to protect the recording head in an inoperative condition and is also used as an ink receiving member in the discharge recovery treatment of the recording head.

Incidentally, it should be noted that the "ink receiving member" is not limited to the cap, but may be of any shape capable of receiving the ink discharged from the recording head. Further, the "discharge recovery treatment" means a treatment wherein the ink is discharged from all of the discharge openings by activating energy generating means arranged internally of the discharge openings and utilized to generate energy for discharging the ink, or the factors leading to the poor discharge such as bubbles, dirt and/or viscosified ink unsuitable for recording are eliminated by applying the suction force within the cap with covering the discharge opening forming surface of the recording head.

A pump (introducing means) 53 provides the suction force for the positive ink discharge and is used for sucking the ink received in the cap 51 during the discharge recovery treatment utilizing the positive ink discharge or preliminary ink discharge. The reference numeral 55 denotes a waste ink containing portion for reserving the waste ink sucked by the pump 53; and 57 denotes a tube communicating the pump 53 with the waste ink containing portion 55. A blade 59 serves to wipe the discharge opening forming surface of the recording head and is shiftable between an extended position where it protrudes toward the recording head to wipe the latter during the movement of the recording head and a retracted position where it is disengaged from the recording head. The reference numeral 61 denotes a motor; and 63 denotes a cam means for receiving a driving power from the motor 61 and for driving the pump 53 and shifting the cap 51 and blade 59.

Next, the head cartridge 9 will be fully described.

Figure 4:
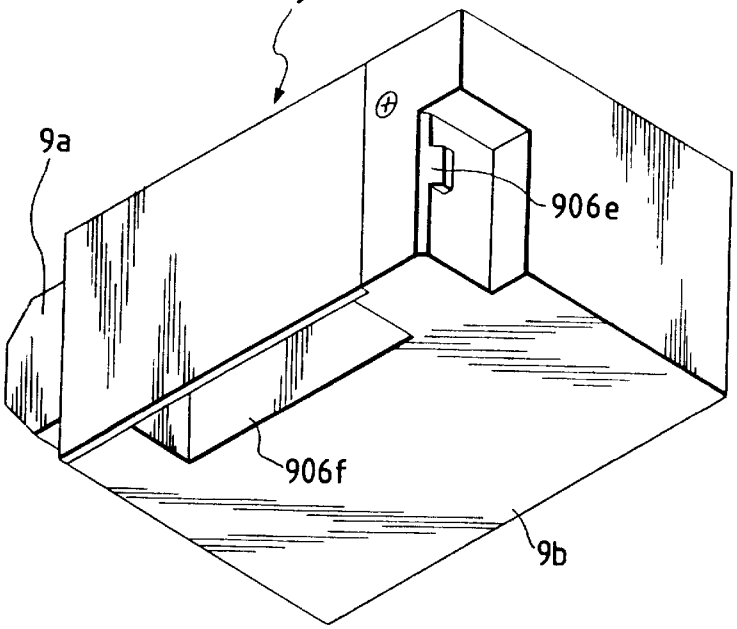
FIG. 4 is a perspective view of a head cartridge shown in FIG. 2.

FIG. 4 shows an outer appearance of the head cartridge 9 integrally including a discharge unit 9*a* constituting an ink jet recording head body and an ink tank 9*b*. In FIG. 4, a pawl 906*a* is disposed within the length of the recording head and can be engaged by the hook 13 formed on the carriage 11 when the head cartridge 9 is mounted on the carriage. Further, in front of the head cartridge 9, in the proximity of the discharge unit 9*a*, there is disposed a positioning abutment (not shown). The reference numeral 906*f* denotes a head opening which is formed on the carriage 11 and into which a support plate provided on the carriage for supporting a flexible substrate (electric connection portion) and rubber pad is inserted.

Figure 5B:
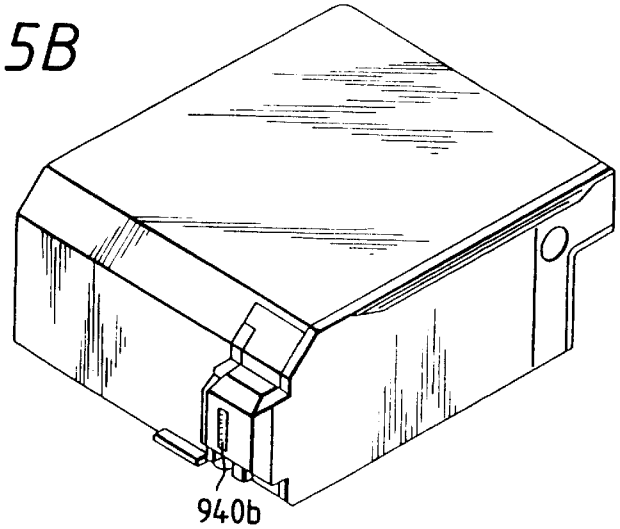
FIGS. 5A and 5B are an exploded perspective view and a perspective view of the head cartridge of FIG. 4, respectively.
Figure 5C:
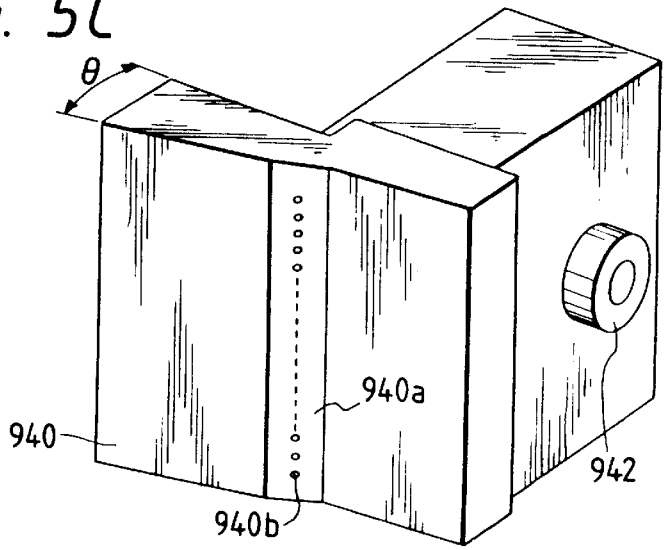
FIG. 5C is a perspective view of a top plate of a recording head of the head cartridge of FIG. 5A.
Figure 5A:
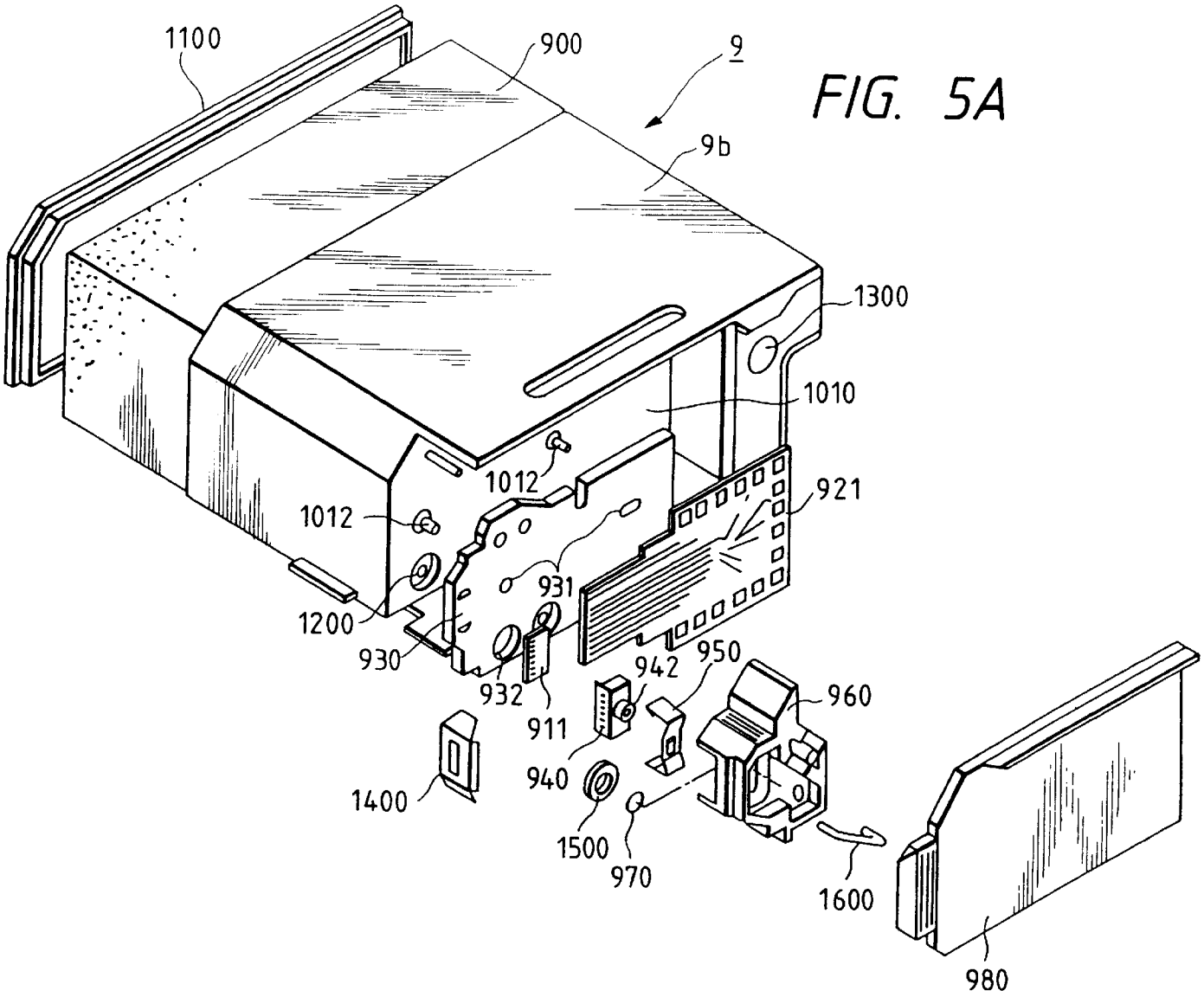

FIG. 5A is an exploded perspective view of the head cartridge of FIG. 4 and FIG. 5B is a perspective view of the head cartridge of FIG. 5A. This head cartridge is of disposable type and integrally includes the ink tank as an ink supply as mentioned above.

In FIG. 5A, a heater board 911 comprises a silicon substrate, and electrical/thermal converter elements (discharge heaters) and an aluminium wiring for supplying electric power to the converter elements is formed on the substrate by the film forming technique. A wiring substrate 921 is associated with the heater board 911 so that the wirings thereof are electrically connected to the corresponding wirings of the heater board. A top plate 940 is provided with partition walls for defining ink passages and a common liquid chamber, and in the illustrated embodiment, the top plate is made of resin material having an orifice plate integrally formed therewith. As shown in FIG. 5C, the discharge opening forming surface of the recording head is inclined by a predetermined angle θ with respect to a plane parallel to a surface (to be recorded) of the recording sheet and has a step 940*a* in the vicinity of the discharge openings. This step is formed in correspondence to the fact that the ink passages in the orifice plate are inclined by a predetermined angle with respect to the rearward in passages in order to form the discharge openings 940*b* by applying a laser beam to a surface of the step through the ink passages in the top plate.

In FIG. 5A, the reference numeral 930 denotes a support plate made of, for example, metal; and 950 denotes a holder spring. By engaging the holder spring by the support plate with interposing the heater board 911 and the top plate 940 therebetween, the top plate 940 is urged against the heater board 911 by a biasing force of the holder spring 950. Incidentally, the wiring substrate 921 is attached to the support plate 930 by an adhesive and the like and the support plate may include a positioning reference for the carriage 11 performing the scanning of the recording head. Further, the support plate 930 also acts as a member for dispersing heat generated by the activation of the heater board 911 to cool the latter.

A supply tank 960 serves to receive the ink from the ink tank 91*b* and acts as a sub-tank for directing the ink into the common liquid chamber formed between the combined heater board 911 and top plate 940. A filter 970 is disposed within the supply tank 960 in the vicinity of an ink supply opening to the common liquid chamber. The reference numeral 980 denotes a lid member for the supply tank 960; and 900 denotes an absorber for holding the ink therein, which is disposed in the ink tank 9*b*.

A supply opening 1200 is used for supplying the ink to a discharge unit comprising the parts 911–980, and is so designed that the ink can be impregnated into the ink absorber 900 by pouring the ink through the supply opening 1200 before the discharge unit is attached to a portion 1010 of the ink tank 9*b*. The reference numeral 1100 denotes a lid member for the head cartridge; and 1300 denotes a vent opening for communicating the interior of the head cartridge with the atmosphere.

When the filling of the ink in the tank 9*b* via the supply opening 1200 is finished, the discharge unit comprising the parts 911–980 is positioned with respect to the portion 1010 and then is attached thereto. The positioning and attaching of the discharge unit can be effected by fitting projections 1012 formed on the ink tank 9*b* into corresponding holes 931 formed in the support plate 930, thus completing the head cartridge 9 as shown in FIG. 5B.

The ink in the cartridge is supplied to the supply tank 960 via the supply opening 1200, an opening 932 formed in the support plate 930 and an introduction opening formed in a back wall (FIG. 5A) of the supply tank 960, and passes through the supply tank, and then is sent from an outlet opening of the supply tank to the common liquid chamber via an appropriate supply tube and an ink introduction opening 942 formed in the top plate 940. Packings made of, for example, silicone rubber or butyl rubber are disposed at connecting junctions in the above ink supplying path, thus ensuring the sealed ink supplying path.

Figure 6:
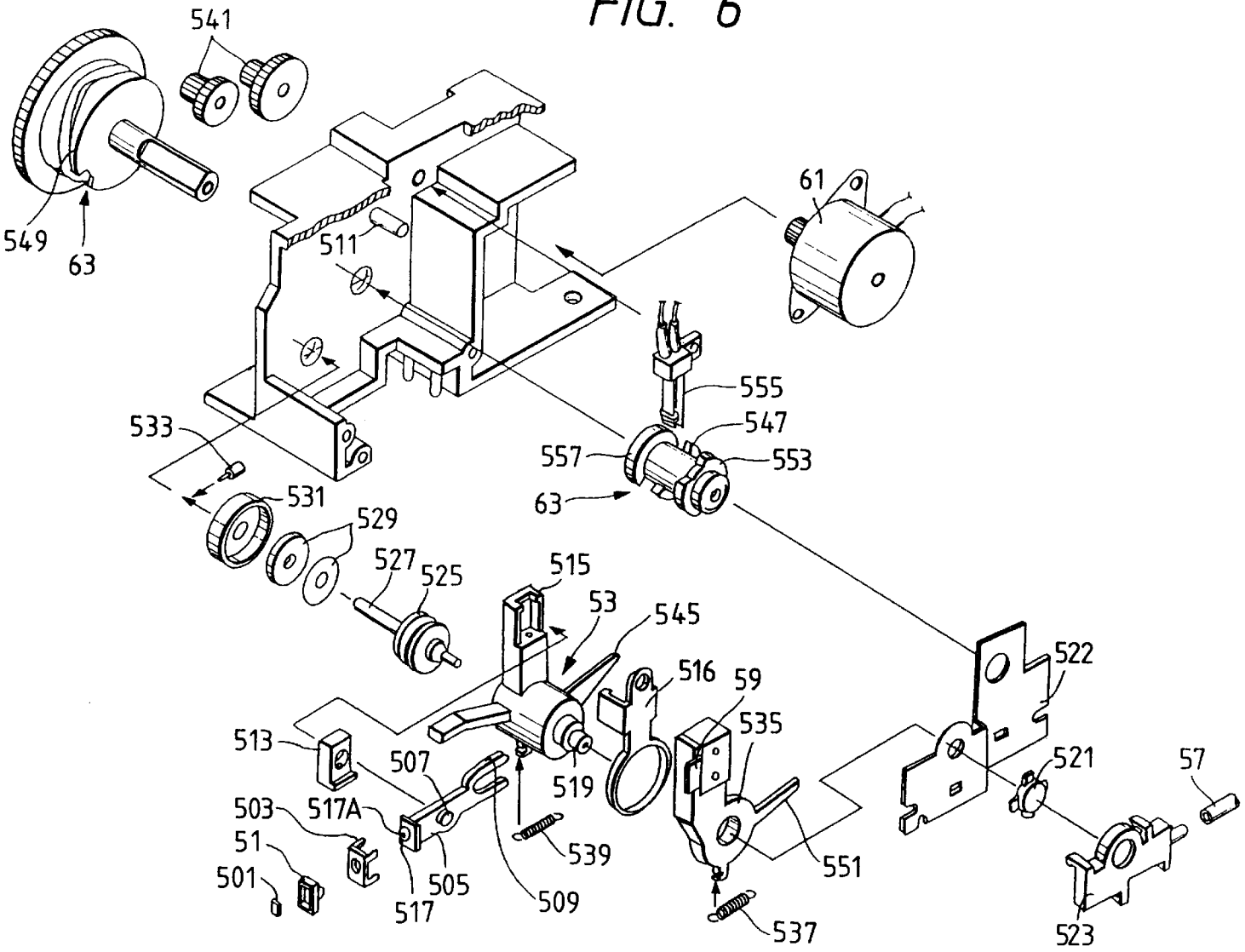
FIG. 6 is an exploded perspective view of a discharge recovery mechanism shown in FIG. 3.

FIG. 6 is an exploded perspective view of the recovery device of FIG. 3 comprising the cap 51, pump 53, blade 59, motor 61, cam means and the like.

The reference numeral 501 denotes an ink absorber disposed within the cap 51; 503 denotes a holder member for holding the cap 51; and 505 denotes a cap lever. The cap lever 505 is pivotally mounted on a pin 507 and is pivoted by a force applied to the pin 507 so that the cap 51 is engaged by or disengaged from the discharge opening forming surface of the head cartridge 9. The reference numeral 511 denotes a pin for limiting the range of the pivotal movement of the cap lever 505 by engaging the latter. A jig 513 is used to attach the cap lever 505 to a support portion 515 of the pump 53 and has a hole into which the in 507 of the cap lever 505 is fitted. The reference numeral 516 denotes a retainer for holding the cap lever in the assembled condition; and 517 denotes an acting portion acting on a central rear side of the cap 51 for applying the cap 51 to a force for abutting the cap against the discharge opening forming surface. The acting portion 517 has an ink inlet 517A for the sucked ink, and ink passages are formed in the pin 505, jig 513 and support portion 515. When the suction force is generated by the pump 53, the ink is introduced into the pump 53 as shown by arrows in FIG. 6 through the above-mentioned ink passages.

The reference numeral 519 denotes a shaft protruding from an end surface of the pump 53 at its central portion; and 522 denotes a pump support plate for holding the shaft 519 to permit the pivotal movement of the pump 53 itself. The rotational force is transmitted to the cap lever 505 via the support portion 515, thus advancing and retarding the cap 51. The reference numeral 521 denotes a waste ink seal for bending the ink passage in the shaft 519 at a right angle; and 523 denotes a waste ink cap for supporting the waste ink seal 521 and forming an ink passage to the waste ink tube 57. Ink passages are formed within the shaft 519, waste ink seal 521 and waste ink cap 523 so that the ink sucked by the pump 53 is introduced into the waste ink containing portion 55 through these ink passages via the tube 57, as shown by arrows in FIG. 6.

The reference numeral 525 denotes a piston of the pump 53; 527 denotes a piston shaft; 529 denotes packings; 531 denotes a cap for the pump 53; and 533 denotes a pin attached to the piston shaft 527 and adapted to receive a force for driving the piston 525. A blade lever 535 to which the blade 59 is attached is pivotally mounted on a shaft protruding from the end surface of the pump 53, so that the blade 59 can be advanced toward and retracted from the recording head by the rotation of the blade lever. The reference numeral 537 denotes a spring for applying a rotational force to the blade lever 535 to advance the latter; and 539 denotes a spring for biasing the cap 51 toward the recording head with respect to the pump 53 itself.

The reference numeral 541 denotes a gear train for transmitting the rotational force of the motor 61 to the cam means 63. The cam means 63 comprises a cam 547 engaging with an engagement portion 545 formed on the pump 53 to rotate the engagement portion, a cam 549 engaging with the pin 533 of the piston shaft 527 to drive the pump 53, a cam 533 engaging with an engagement portion 551 formed on the blade lever 535 to rotate the engagement portion, and a cam 557 engaging with a switch 555 for detecting a home position of the cam means 63. The operation of these cams will be described later.

Figure 7B:
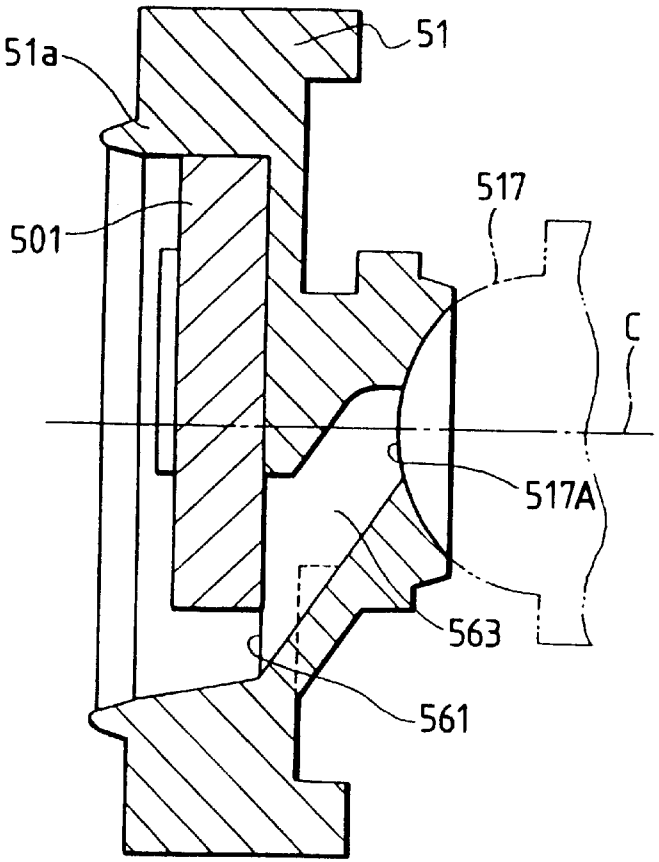
FIGS. 7A and 7B are an elevational view and a side sectional view of a cap, respectively, according to the preferred embodiment of the present invention.
Figure 7A:
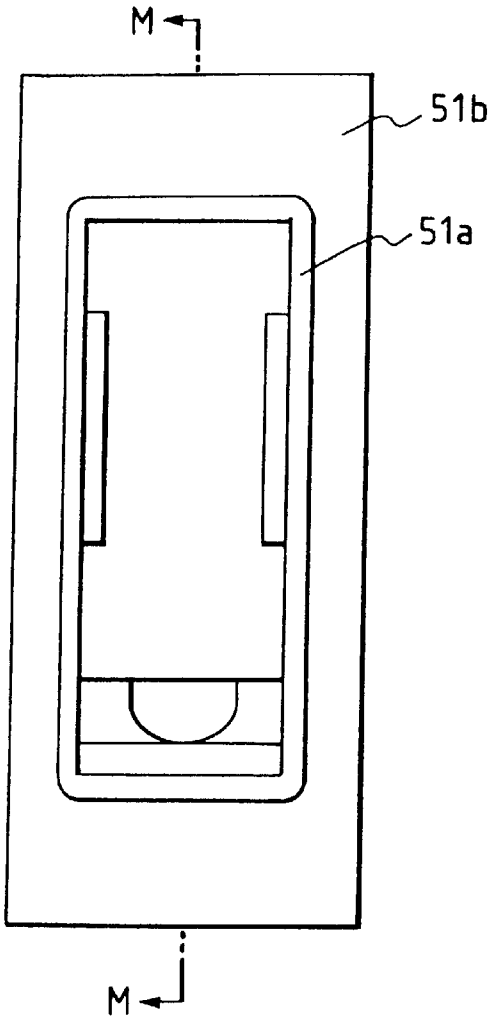

The construction of the cap 51 is shown in FIG. 7A and in FIG. 7B showing a section of the cap taken along the line M—M of FIG. 7A.

In FIGS. 7A and 7B, the reference numeral 51*a* denotes a rib formed on the cap 51; and 51*b* denotes a peripheral portion around the rib.

In the illustrated embodiment, the cap 51 is made of elastic material such as rubber in order to improve the sealing contact between the cap and the recording head of the head cartridge 9. In the capping operation, the cap is urged against the orifice plate portion of the top plate 940 with an urging force of about 60–80 grams. Within the cap 51, an ink suction opening 561 is formed at a lower portion thereof and an ink passage 563 is formed between the suction opening and the ink inlet 517A formed in the acting portion 517 of the cap lever 505. Further, the suction opening 561 is not completely covered by the absorber 501. With this arrangement, even when the ink flows downwardly by its own weight, since the ink can be sucked through the lower ink suction opening 561, an amount of the residual ink in the absorber 501 can be greatly reduced to greatly delay the deterioration of the absorber due to the solidification of the ink, thus increasing the service life of the absorber and accordingly of the cap 51 including the absorber.

Next, the function of the recovery unit according to the illustrated embodiment will be explained with reference to FIGS. 8–12.

Figure 8A:
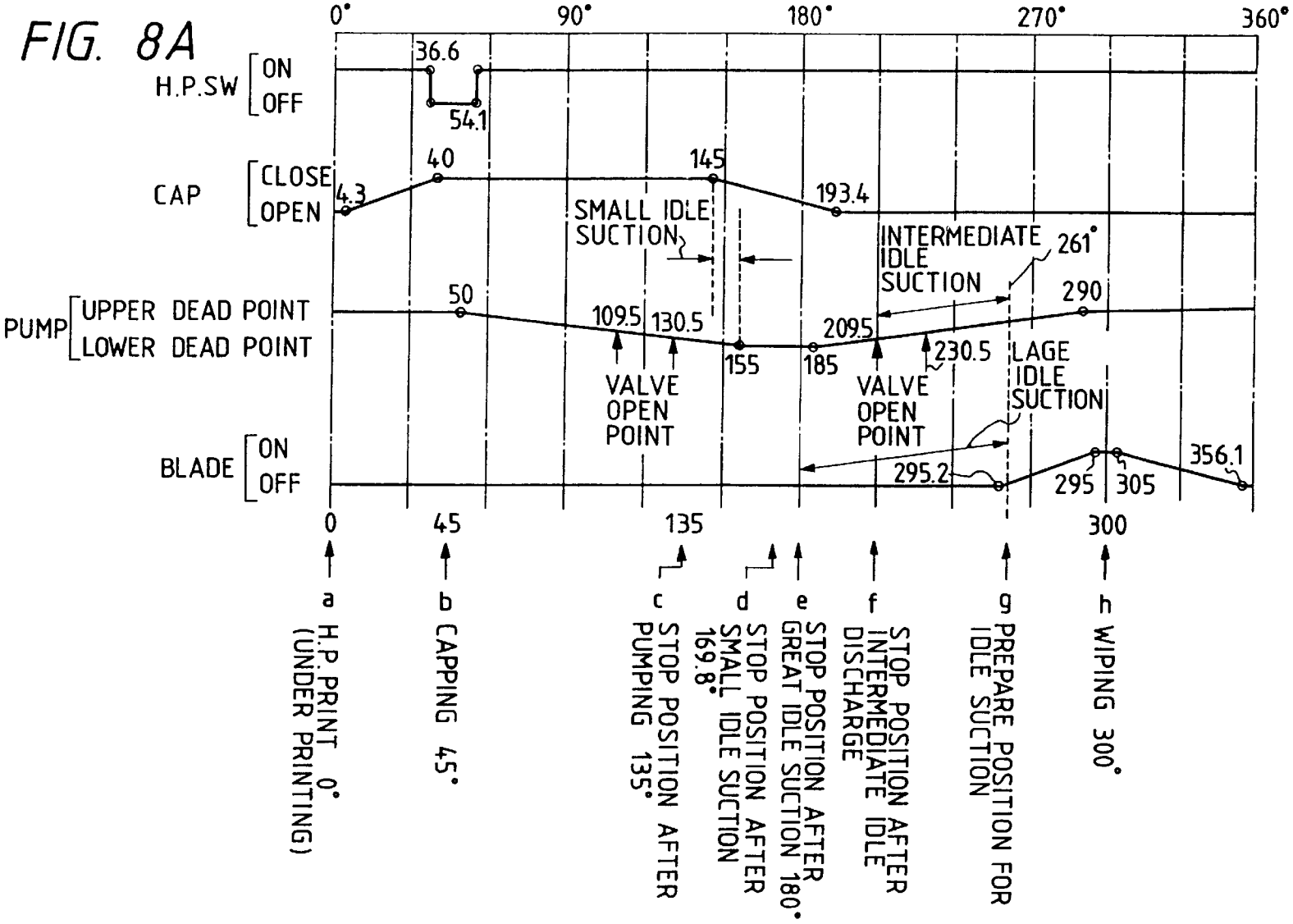
FIG. 8A is a view showing cam profiles for driving the discharge recovery mechanism.
Figure 8B:
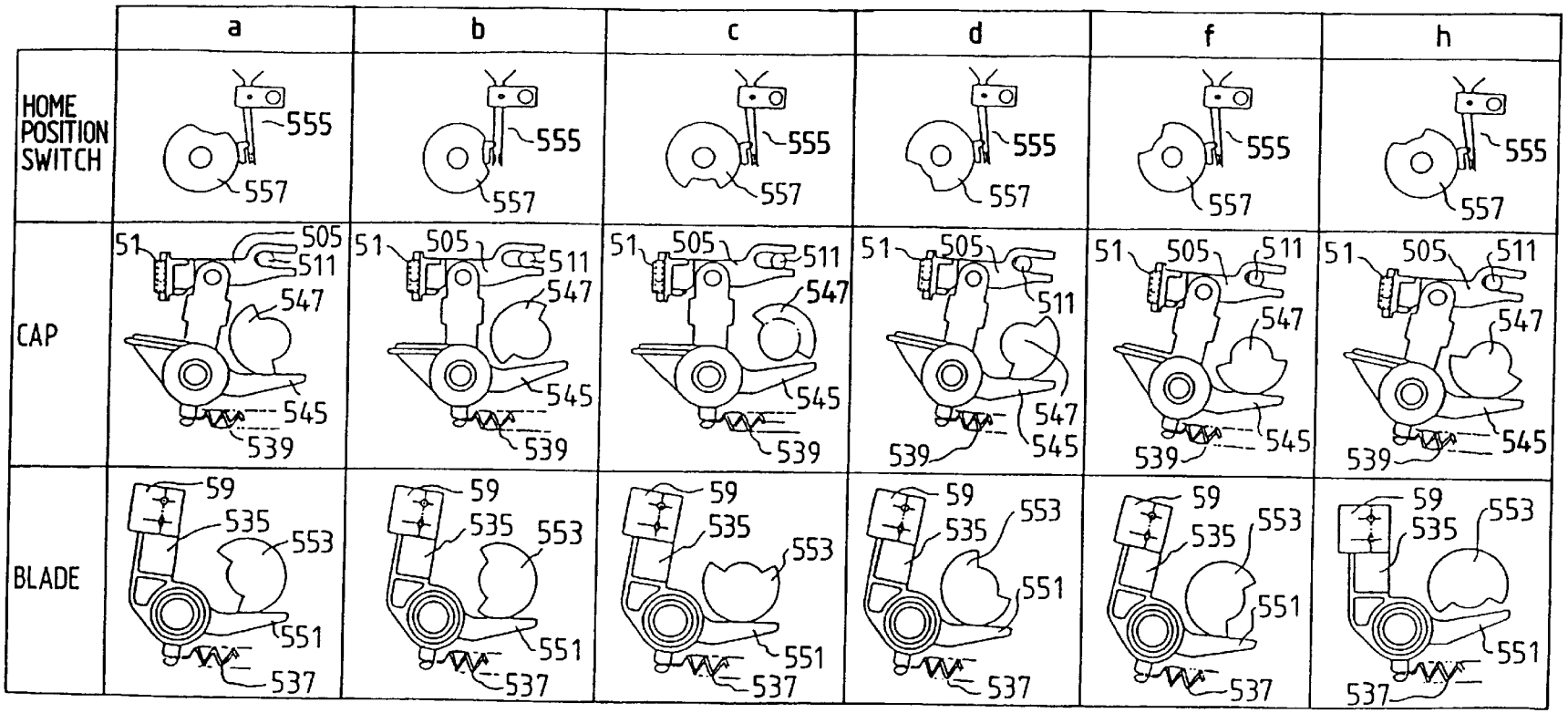
FIG. 8B is an explanatory view showing various conditions of several constructural elements.
Figure 10:
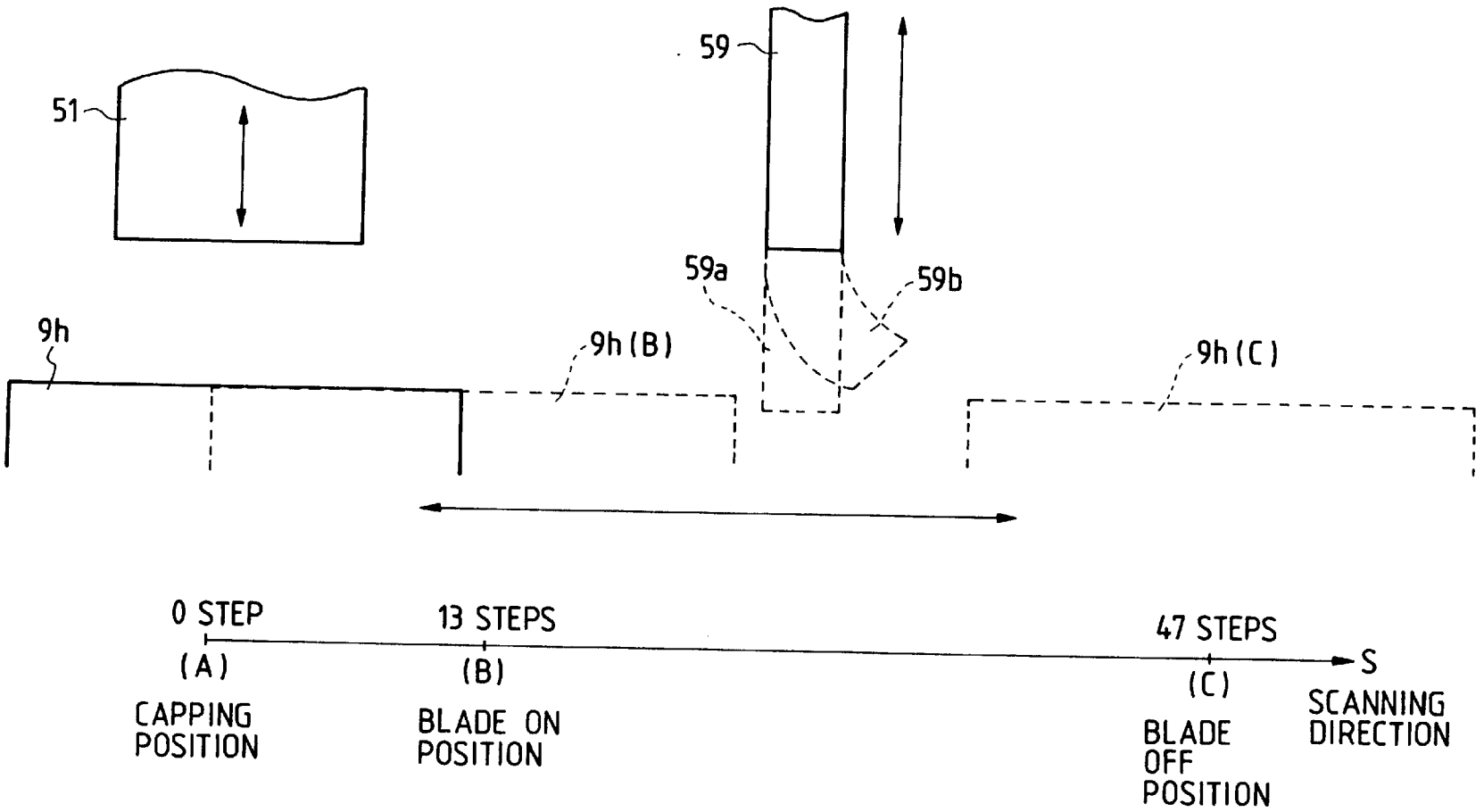
FIG. 10 is a view showing scanning positions of the head cartridge according to the preferred embodiment of the present invention.
Figure 11:
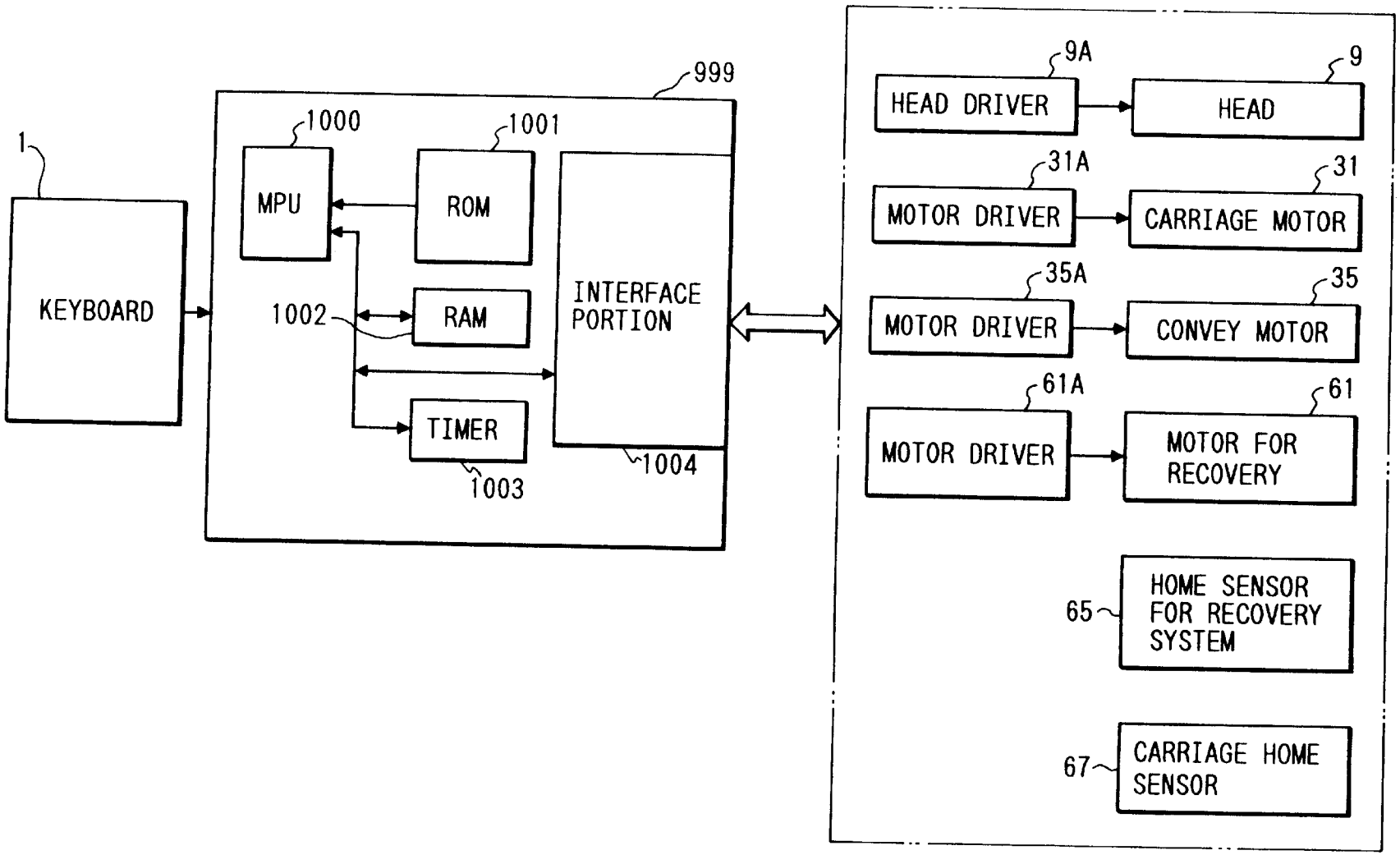
FIG. 11 is a block diagram of a control system of the ink jet recording system according to the preferred embodiment of the present invention.
Figures 12, 12A:
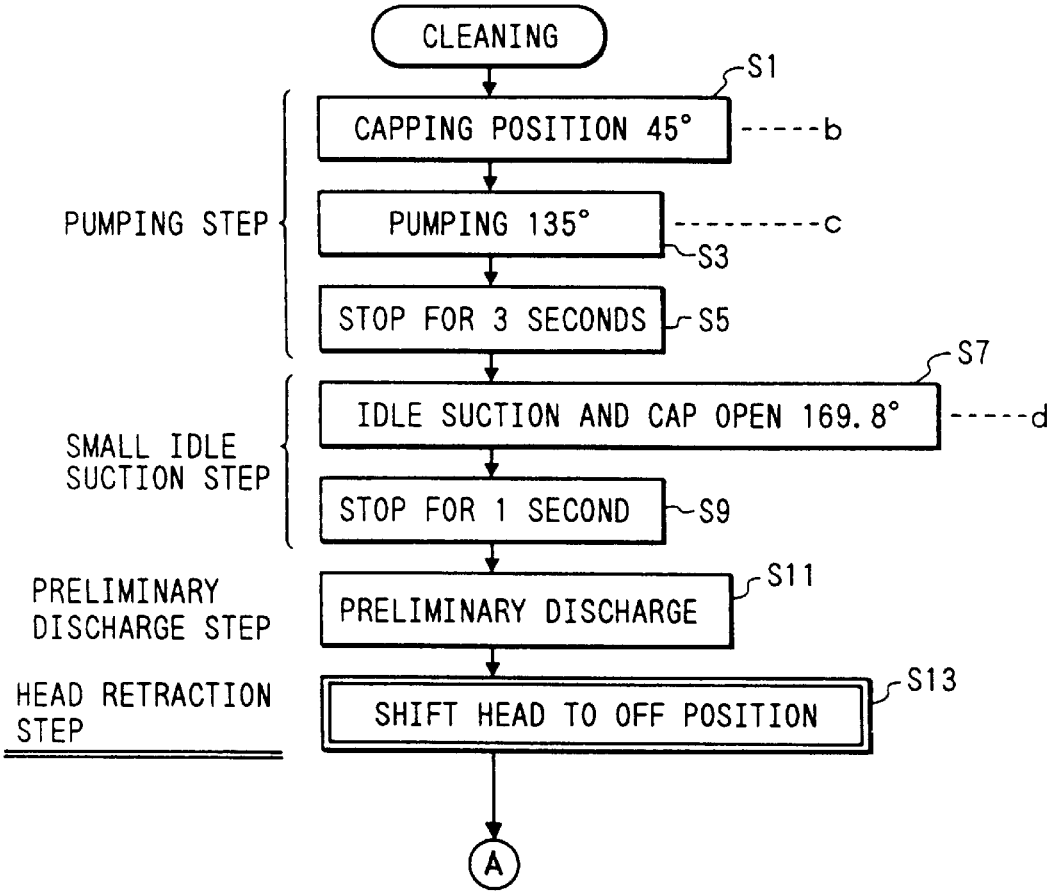
FIG. 12 is a flowchart showing an example of a cleaning sequence in a discharge recovery treatment.
Figure 12B:
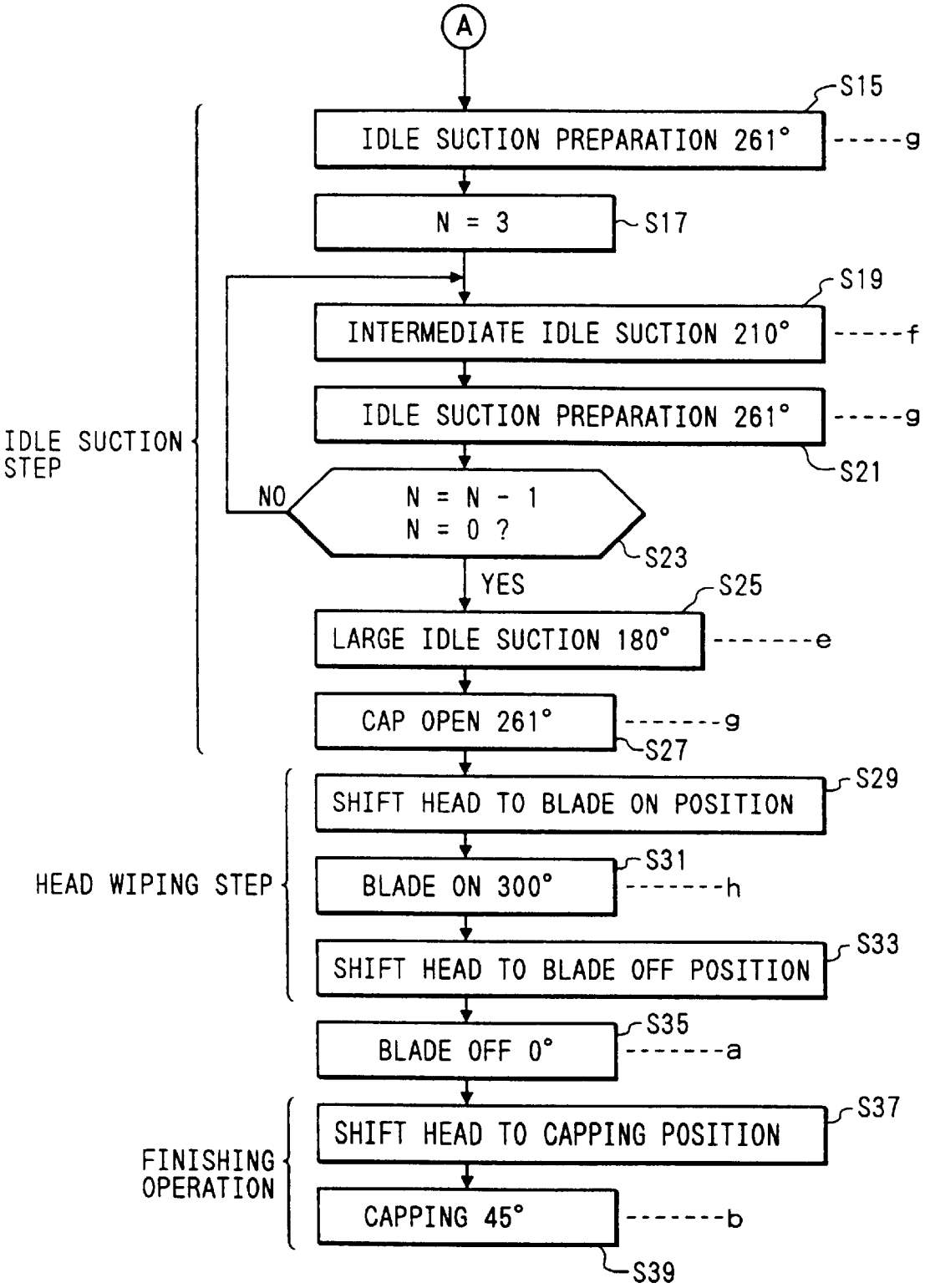

FIG. 8A shows a cam chart of the recovery device, where an abscissa indicates an rotational angle of the cam 549. FIG. 8B shows conditions of the switch 555, cap 51, pump 53 and blade 59. FIGS. 9A to 9E show various positions of the piston 525 within the pump 53. FIG. 10 shows a positional relation between the cap 51 and the blade 59 during the scanning of the discharge opening forming surface 9*h* of the head of the head cartridge 9 in the direction S. FIG. 11 shows a block diagram of the control system of the ink jet recording system according to the illustrated embodiment. FIG. 12 shows a flow chart for explaining a cleaning operation for the recording head carried by the recovery unit.

In FIG. 8A, a indicates a home position of the cam 549, i.e., a waiting condition where the recovery device is waiting because of under printing or recording. In this condition, the switch 555 is turned ON, the cap 51 is separated from the discharge opening forming surface of the recording head (referred to as "open condition" hereinafter), the pump 53 is at its upper dead point and the blade is in an OFF condition, i.e., a condition where it is separated from the recording head.

The letter b indicates a capping condition, i.e., a condition where the printer is in an inoperative position and the discharge opening forming surface is covered by the cap for protection. In this condition, the switch 555 is turned OFF, the cap 51 is urged against the discharge opening forming surface of the head ("close condition"), the pump 53 is at its upper dead point, and the blade is in an OFF condition.

The letter c indicates a condition when the pumping is finished. In this condition, the switch 555 is turned ON, the cap 51 is in the closed condition, the pump 53 is in a condition where the valve is completely opened but it does not yet reach a lower dead point, and the blade is in the OFF condition.

The letter d indicates a condition when the small idle suction is finished by opening the cap 51 after the capping operation and at the same time by sucking the ink within the cap 51 and within the cap lever 505 into the pump 53. In this condition, the switch 555 is turned ON, the cap 51 is in a half-open condition, the pump 53 is at its lower dead point, and the blade is in the OFF condition. In this embodiment, the recording head is retarded to the blade OFF position.

The letter g indicates a prepare position for idle suction for discharging the ink filled in the pump 53 (after pumping) into the waste ink tank. In this condition, the switch 555 is turned ON, the cap is in the open condition, the pump 53 is in a position slightly below the upper dead point, and the blade is in the OFF condition.

The letters e and f indicate stop positions for large idle discharge and intermediate idle discharge, respectively. In both positions, the switch 555 is turned ON, the cap is in the open condition and the blade is in the OFF condition. However, in the condition e, the pump 53 is at the lower dead point; whereas, in the condition f, the pump is in a position above the lower dead point.

The letter h indicates a wiping condition. In this condition, the switch 555 is turned ON, the cap is in the open condition, the pump is at its upper dead point, and the blade is in an ON condition. In this condition, the wiping operation for wiping the discharge opening forming surface of the head is effected while shifting the carriage on which the head cartridge is mounted.

Figure 9A:
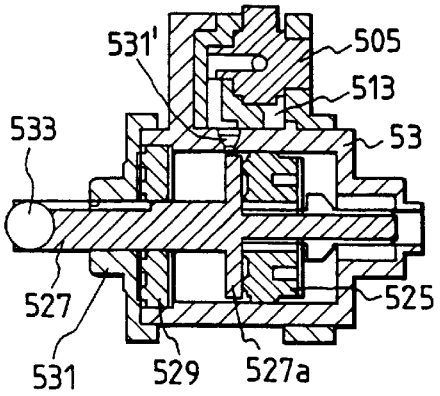
FIGS. 9A to 9E are explanatory views for explaining an operation of a pump according to the preferred embodiment of the present invention.

FIG. 9A indicates a condition that the piston 525 within the pump is at the lower dead point. In the interior of the pump 53, the negative pressure generated in a chamber at a left side of the piston 525 causes the pumping operation.

The reference numeral 531' denotes a communication opening for transmitting the negative pressure to the cap 51. In the condition shown in FIG. 9A, the piston is in a condition that it has passed through the communication opening 531' and reaches the right side of the latter. In this case, since the piston 525 is urged by a flange portion 527*a* of the piston shaft 527 from the left to be sealingly contacted by the flange portion, the generated negative pressure is transmitted to the cap 51 without leading. Further, the ink remaining in a chamber at a right side of the piston 525 is discharged to the waste ink tank.

Figure 9C:
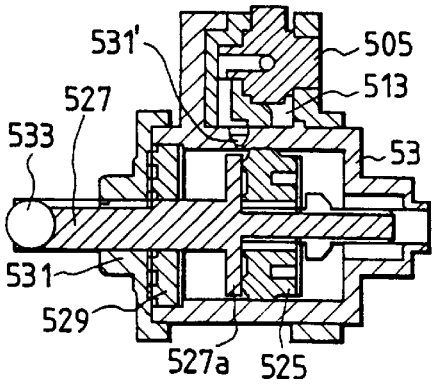
Figure 9B:
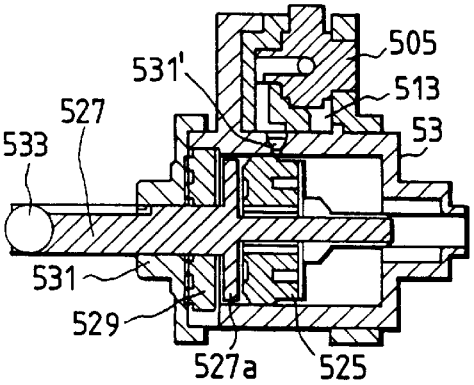

FIG. 9B indicates a condition that the piston 525 is at its upper dead point. It should be noted that, in this condition, the piston 525 is positioned at the left of the communication opening 531' and thus the communication opening 531' is not closed. That is to say, in this condition, the cap 51 is communicated with the atmosphere.

FIG. 9C indicates a condition of the pump 53 corresponding to the condition c in FIG. 8A. In this condition, the piston 525 has passed through the communication opening 531' and is positioned at the right of the latter.

Figure 9D:
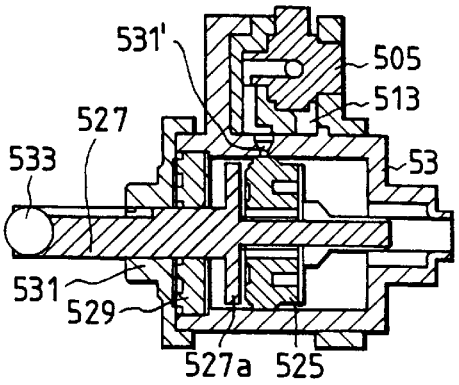

FIG. 9D indicates a condition corresponding to the condition g in FIG. 8A. By reciprocally repeating this condition and the condition shown in FIG. 9A or FIG. 9E, the large idle suction and the intermediate idle suction can be effected.

Figure 9E:
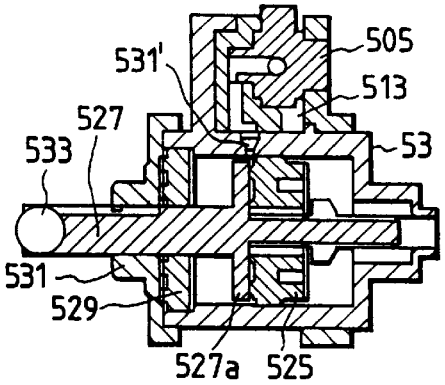

FIG. 9E indicates a condition when the intermediate idle suction is finished. It should be noted that, in this condition, the piston 525 is stopped immediately after it has passed through the communication opening 531'. If the piston goes to the lower dead point (FIG. 9A), when the piston returns to the upper dead point (FIG. 9B) or to the prepare position for idle suction (FIG. 9D), the time period when the communication opening 531' is not closed by the piston will be increased. In this case, in order to prevent the positive pressure from generating in the left chamber of the piston, it is so designed that a slight clearance is created between the flange portion 527*a* of the piston shaft and the piston 525 to communicate the left chamber with the right chamber of the piston 525. However, since the slight position pressure is created due to the presence of grease and the like in the flow path, it is feared that the back flow of pressurized air occurs.

In the illustrated embodiment, such back flow will be generated in the case where the positive pressure is created in the right chamber of the pump when the piston 525 is shifted while opening the communication opening 531', for example, in the case where the piston 525 shifts from the upper dead point (FIG. 9B) to the prepare position for idle suction (FIG. 9D). Further, the back flow will be also generated in the case where the positive pressure is created in the left chamber of the pump when the piston 525 is shifted while opening the communication opening 531', for example, in the case where the piston 525 shifts from the lower dead point (FIG. 9A) to the prepare position for idle suction (FIG. 9D). Thus, the control of the relative position between the recording head and the ink receiving member may be effected at least when the piston is returned after the suction operation or when the piston is reversed during the reciprocal movement thereof.

The positional relation of the discharge opening forming surface 9*h* of the head of the head cartridge 9 shown in FIG. 10 is illustrated, by using, as a reference, the capping position (A), i.e., a position where the discharge opening forming surface 9*h* of the head of the head cartridge 9 is in front of the cap 51 of the discharge recovery device. Now, the number of steps shown in FIG. 10 represents a driving amount of a pulse motor for performing the scanning in the direction S, and the driving amounts corresponding to 6/360 inch=1/60 inch=0.423 mm per each step.

When the wiping operation is performed, first of all, the discharge opening forming surface 9*h* of the head is shifted up to a blade ON position (B) as shown by 9*h* (B), and then, the blade 59 is advanced up to a position 59*a* by turning the blade in the discharge recovery device ON. Then, as shown by 9*h* (C), the wiping operation is carried out by shifting the discharge opening forming surface 9*h* up to a blade OFF position (C). In this case, since the blade 59 is made of the elastic material such as rubber, as shown by 59*b* in FIG. 10, the blade can remove the undesirable ink adhered to the surface of the discharge opening forming surface 9*h* while being deformed. When the discharge opening forming surface 9*h* is shifted up to the blade OFF position (C), the blade is retarded to the original position.

Incidentally, in the illustrated embodiment, the retarded position of the recording head corresponds to the blade OFF position.

FIG. 11 is a block diagram showing an example of the control system of the recording system having the above-mentioned construction.

The capping position and the shifted position of the carriage 11 can be known on the basis of the detection results from a home sensor 65 for recovery system and a carriage home sensor 67. In FIG. 11, an MPU 1000 constitutes a microcomputer 999, executes a control sequence which will be described later, generates a controls signal, and control various elements. A ROM 1001 stores a program corresponding the control program, and a RAM 1002 is used as a work area for the execution of the control program. The reference numeral 1003 denotes a timer for measuring the time.

The flow chart of FIG. 12 shows an example of a sequence of the discharge recovery treatment executed by the recovery unit under the control of the MPU 1000 of FIG. 11.

First of all, the sequence is started from the condition b shown in FIG. 8A (capping condition (step S1). When the condition c (FIG. 8A) (stop position) is reached, the pumping is effected (step S3), and the stop for 3 seconds is effected at that condition for sucking the ink sufficiently (step S5). In the condition d (stop position), the cap is opened and at the same time the small idle suction is effected (step S7), and the stop for 1 second is effected to adequately suck the ink from the cap 51 and the cap lever 505 (step S9).

Then, after the preliminary discharge (step S11), the recording head is shifted to the blade OFF position before the idle suction (step S13). As a result, the cap is moved to a position where it is not opposed to the recording head.

Then, the idle suction is effected to discharge the ink filled in the pump 53. First of all, the condition g (prepare position for idle suction) is reached (step S15), and then the shift between this condition and the condition f (stop position for intermediate idle suction) is reciprocally repeated by three times (steps S17–S23). Then, by shifting the recording head from the condition g (stop position) to the condition e (stop position), the large idle suction is effected (step S25), thus expelling the ink in the pump 53 toward the waste ink tank adequately. Then, the recording head is shifted to the condition g (step S27), i.e., the recording head is shifted to the blade ON position (step S29). And, by turning the blade ON at the position h (step S31) and by shifting the recording head to the blade OFF position, the wiping is effected (step S33). At last, at the position a, the blade is turned OFF (step S35), the recording head is returned to the capping position (step S37), and the capping is effected at the position b (step S39).

Incidentally, the "small idle suction" means a part of a remaining stroke of the normal suction, the "intermediate idle suction" means a stroke from an upper periphery of the communication opening to a lower periphery of the opening, and the "large idle suction" means a stroke from the periphery of the communication opening to the lower dead point.

As mentioned above, in the illustrated embodiment, since the ink receiving member is controlled so that it is not disposed in confronting relation to the recording head during the introducing process wherein the ink discharged from the recording head and received in the cap is directed to the waste ink containing portion by means of the introducing means, even if the back flow of the bubble-shaped ink occurs, the excessive ink does not adhere to the surface of the recording head. Incidentally, in order to prevent the bubble-shaped ink including air and scattered ink from the ink receiving member due to the back flow of the ink from being liquidized and from being entered into the recording system, for example, as shown in FIG. 3, it is preferable that a sheet made of polyvinyl chloride resin is provided at a position 59*a* where the scattered ink may be dropped and an ink absorber is arranged on the sheet to absorb the dropped ink. Further, the ink which tries to scatter may be absorbed by an additional ink absorber (not shown) by disposing the additional ink absorber in confronting relation to the ink receiving member when the back flow of the ink occurs.

Incidentally, in the illustrated embodiment, while an example that the recording head is retarded by slidingly shifting it in the right direction regarding the recording system was explained, the present invention is not limited to this example, but the recording head may be retarded by shifting it in the left direction of the recording system or in a direction for away from the system.

Further, in the illustrated embodiment, in order that the cap is not disposed in confronting relation to the recording head, while an example that the recording head is retarded up to the blade OFF position. However, regarding the mode for "controlling the relative position between the recording head and the ink receiving member", the present invention is not limited to this example, but the recording head may be retarded to a position other than the blade OFF position, where the recording head is disposed asymmtrically with respect to the cap. Further, in place of shifting the recording head (i.e., the head is stationary), the cap may be shifted so that the cap is not disposed in confronting relation to the recording head. Further, both of the recording head and the cap may be displaced so that the cap is not disposed in confronting relation to the recording head. Further, in order that the cap is not disposed in confronting relation to the recording head, either one or both of the recording head and the cap may be locked when they are not in confronting relation to each other. However, as explained in relation to the illustrated embodiment, when only the recording head is displaced to the asymmetrical position regarding the cap, since this displacement can be effected only by altering a part of the discharge recovery treatment sequence without changing the arrangement or construction of the recording system, it is very effective and advantageous.

Incidentally, in the illustrated embodiment, as shown in FIG. 12, the retarding operation of the recording head was effected in the step S13 after the small idle suction has been effected in the step S7. This is the reason why the back flow of the ink occurs after the ink is sucked into the pump by the small idle suction. Accordingly, in the present invention, the control step for controlling at least one of the recording head and the cap so that the cap is not disposed in confronting relation to the recording head during the introducing process wherein the ink discharged from the recording head and received in the cap is directed to the waste ink receiving portion by means of the introducing means may be effected before the ink is scattered from the cap due to the back flow of the ink during the introducing process, and when this requirement is met, the control step may be effected after such introducing process is started. Thus, the timing of the initiation of the control step is not limited so long as the above requirement is met.

Thus, control signals such as a retard signal for the recording head may be emitted from the MPU 1000 shown in FIG. 11 before the ink is scattered from the cap due to the back flow of the ink and the control may be performed on the basis of these control signals. Accordingly, for example, when the scattering of the ink from the cap due to the back flow of the ink occurs only after a plurality of idle suction processes have been effected, it is not necessary to perform the control step or process per each idle suction process, but the control step may be performed only when the ink is scattered from the cap during the plural idle suction processes.

As mentioned above, according to the illustrated embodiment, it is possible to prevent the excessive ink from adhering to the recording head without providing any special valve mechanism. However, the present invention can be applied to the case where the back flow of the ink occurs due to the mulfunction of the system even if the special valve mechanism is provided in the pump.

As mentioned above, according to the illustrated embodiment, it is possible to prevent the excessive ink from adhering to the recording head with very easy operation control. Accordingly, since the ink discharging condition from the recording head is always kept effective and the amount of ink adhered to the recording head is reduced, the contamination of the blade during the wiping operation for removing the excessive ink from the recording head is reduced, and accordingly, even when a large number of prints are continuously produced, the wiping ability is not worsened, this improving the printing quality considerably. Further, since the special valve mechanism is not required, it is possible to make the recording system small-sized and inexpensive.

Next, another embodiment of the present invention will be fully explained with reference to the accompanying drawings.

Figure 13:
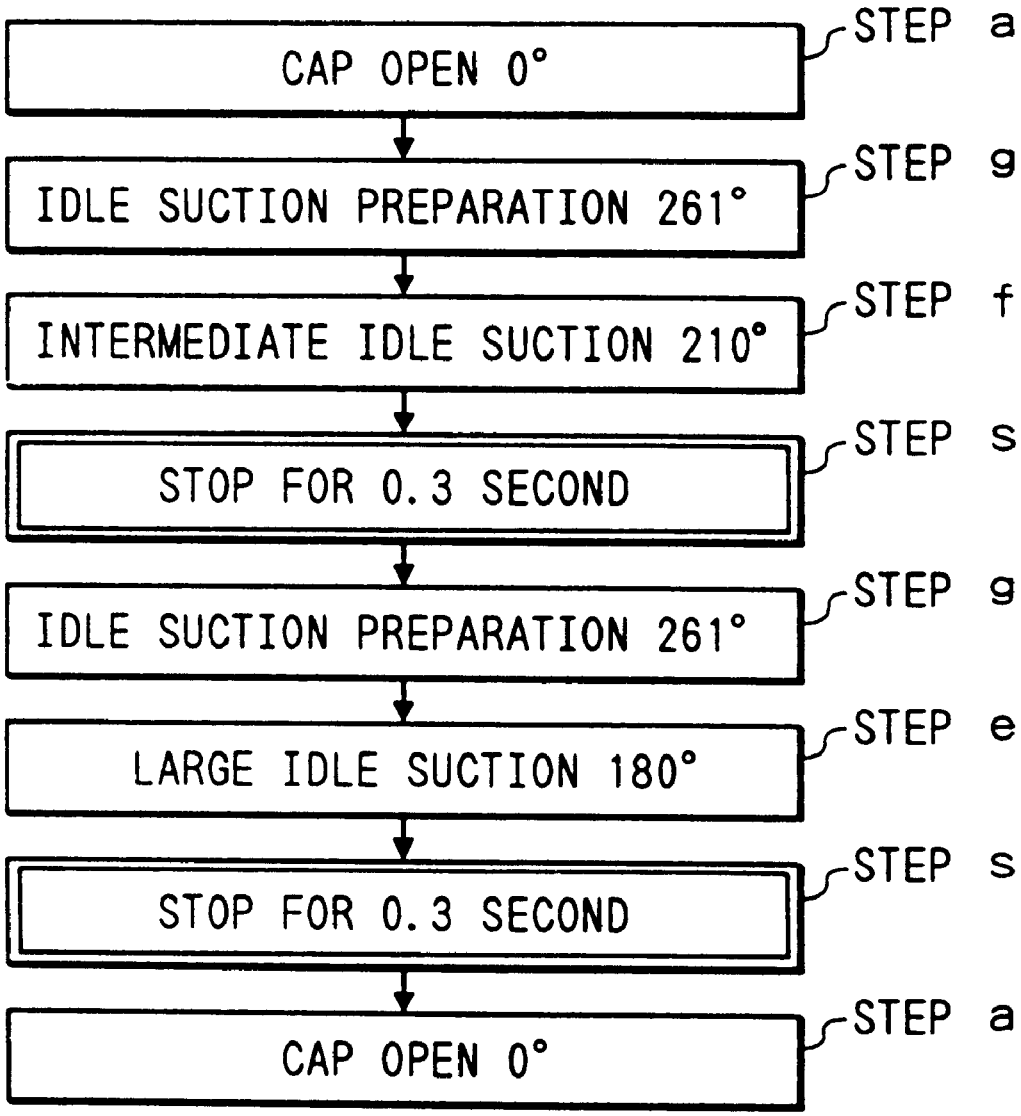
FIG. 13 is a flow chart showing a main sequence according to another embodiment of the present invention.

FIG. 13 is a flow chart for explaining a suction recovery sequence according to this embodiment.

A suction pump used in this embodiment has a volume of 178.2 $mm^3$ in which a piston is shifted between the upper dead point and the lower dead point, and volume changes of 144.25 $mm^3$, 86.5 $mm^3$ and 16.9 $mm^3$ during the large idle suction, intermediate idle suction and small idle suction following a suction process (described later), respectively, similar to the pump shown in FIG. 6. And, as the pump, a compact pump having no valve mechanism is used. As a result, the installation space for the pump can be reduced considerably. Incidentally, in this embodiment, an ink receiving volume from the cap to the suction opening is 36.68 $mm^3$. In comparison with this ink receiving volume, the volumes regarding the large idle suction, the intermediate idle suction and the three small idle suctions will be about 4 times, about 2.4 times and about 7 times, respectively. However, the present invention is not limited to such values.

Now, in FIG. 13, in order to permit the idle suction, the cap is separated from the recording head or a valve in the cap is unseated to communicate the cap which was sealingly contacted with the recording head with the atmosphere (step shown by a). Subsequently, after a piston suction opening shielding elastic member has been positioned at the prepare position for idle suction near the suction opening of the pump (step shown by g), the elastic member is shifted to the intermediate idle suction position exceeding the suction opening (step shown by f), and at the same time the stop for 0.3 second is effected at this position (step shown by s).

In this way, the ink sucked into the pump is maintained in a condition that the ink can be discharged from the pump. Accordingly, any factors which tend to cause the back flow of the ink during the conventional idle suction can be greatly reduced.

In the illustrated embodiment, the large idle suction achieving the larger discharge than that of one process of the intermediate idle suction is performed. Also in this case, the starting position is the same as the above-mentioned prepare position for idle suction, and the piston is returned to this position (step shown by g). Thereafter, the elastic member is shifted to a position for large idle suction (lower dead point) exceeding the suction opening (step shown by e), and at the same time the stop for 0.3 second is effected at that position (step shown by s). As a result, the ink sucked into the pump including the residual ink remaining in the ink passage from the cap to the pump is discharged from the pump, with the result that the amount of ink remaining in the pump can be greatly reduced, thus ensuring the stable condition. Therefore, it is possible to stabilize the recovery device permitting the effective recording of the recording head for a long time.

Incidentally, angles shown in FIG. 13 indicate rotational angles of a cam described later. But, these angles do not limit the present invention. The above-mentioned stop period is preferably less than 1 second, and, is more preferably less than 0.5 second for the practical intermediate idle suction and large idle suction. The lower limit for the stop period is preferably 0.1 second or more.

In FIG. 14, an encircled a indicates a home position of the cam 549, i.e., a waiting condition where the recovery device is waiting because of under printing. In this condition, the switch 555 is turned ON, the cap 51 is separated from the discharge opening forming surface of the recording head (referred to as "open condition" hereinafter), the pump 53 is at its upper dead point and the blade 59 is in an OFF condition, i.e., a condition where it is separated from the recording head. The letter b indicates a capping condition, i.e., a condition where the printer is in an inoperative position and the discharge opening forming surface is covered by the cap for protection. In this condition, the switch 555 is turned OFF, the cap 51 is urged against the discharge opening forming surface of the head ("close condition"), the pump 53 is at its upper dead point, and the blade is in an OFF condition.

The letter c indicates a condition when the small idle suction is finished by opening the cap 51 after the capping operation and at the same time by sucking the ink within the cap 51 and within the cap lever 505 into the pump 53. In this condition, the stop for 1 second is effected to enhance the discharge of the ink (refer to a step S9 in FIG. 16). In this case, the switch 555 is turned ON, the cap 51 is in a half-open condition, the pump 53 is at its lower dead point, and the blade is in the OFF condition. In this condition, the recording head is retarded to the blade OFF position.

The letter g indicates a prepare position for idle suction for discharging the ink filled in the pump 53 (after pumping) into the waste ink tank. In this condition, the switch 555 is turned ON, the cap is in the open condition, the pump 53 is in a position slightly below the upper dead point, and the blade is in the OFF condition.

The letters e and f indicate stop positions for large idle discharge and intermediate idle discharge, respectively. In both positions, the switch 555 is turned ON, the cap is in the open condition and the blade is in the OFF condition. However, in the condition e, the pump 53 is at the lower dead point; whereas, in the condition f, the pump is in a position above the lower dead point. In these positions, the stop period is considerably shorter than that in the above stop position d, which is shorter than 1 second, and is preferably shorter than 0.5 second (in the illustrated embodiment, 0.3 second) is adopted. This stop period may be a period from when the suction opening is closed by the elastic member to when the vibration of the elastic member is stabilized. In any case, by providing this stop period, it is possible to ensure the effective suction efficiency of the idle suction operation and to eliminate the factors causing the back flow of the ink considerably.

The letter h indicates a wiping condition. In this condition, the switch 555 is turned ON, the cap is in the open condition, the pump is at its upper dead point, and the blade is in an ON condition. In this condition, the wiping operation for wiping the discharge opening forming surface of the head is effected while shifting the carriage on which the head cartridge is mounted.

Figure 15A:
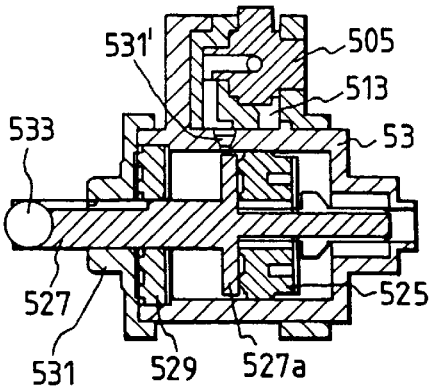
FIGS. 15A to 15E are explanatory views for explaining an operation of a pump according to this embodiment.

FIG. 15A indicates a condition that the piston 525, within the pump is at the lower dead point. In the interior of the pump 53, the negative pressure generated in a chamber at a left side of the piston 525 causes the pumping operation. The reference numeral 531' denotes a communication opening for transmitting the negative pressure to the cap 51. In the condition shown in FIG. 15A, it can be seen that the piston 525 is in a condition that it has passed through the communication opening 531' and reaches the right side of the latter. In this case, since the piston 525 is urged by the flange portion 527*a* of the piston shaft 527 from the left to be sealingly contacted by the flange portion, the generated negative pressure is transmitted to the cap 51 without leaking. Further, the ink remaining in a chamber at a right side of the piston 525 is discharged to the waste ink tank.

Figure 15C:
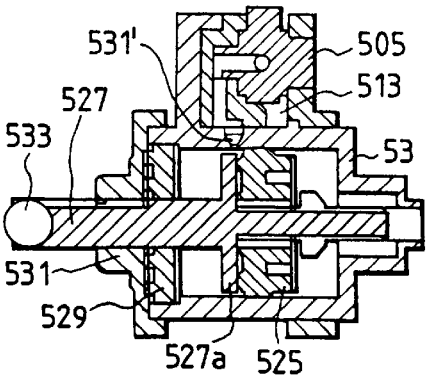
Figure 15B:
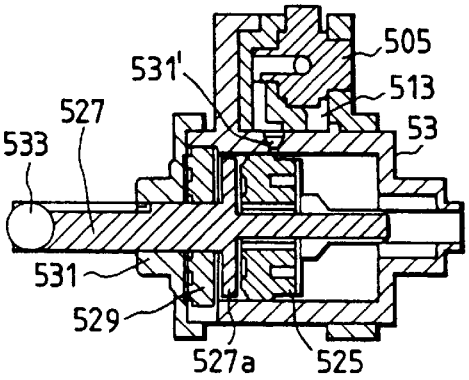

FIG. 15B indicates a condition that the piston 525 is at its upper dead point. It should be noted that, in this condition, the piston 525 is positioned at the left of the communication opening 531' and thus the communication opening 531' is not closed. That is to say, in this condition, the cap 51 is communicated with the atmosphere.

FIG. 15C indicates a condition of the pump 53 corresponding to the condition c in FIG. 14. In this condition, the piston 525 has passed through the communication opening 531' and is positioned at the right of the latter.

Figure 15D:
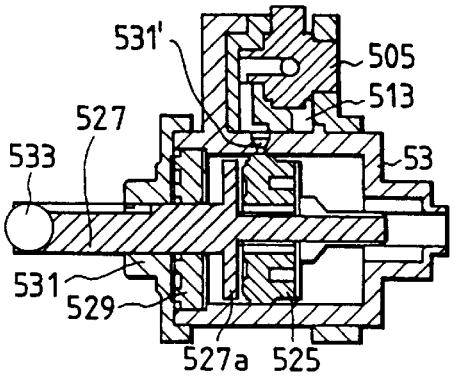

FIG. 15D indicates a condition corresponding to the condition g in FIG. 14. By reciprocally repeating this condition and the condition shown in FIG. 15A or FIG. 15E, the large idle suction and the intermediate idle suction can be effected.

Figure 15E:
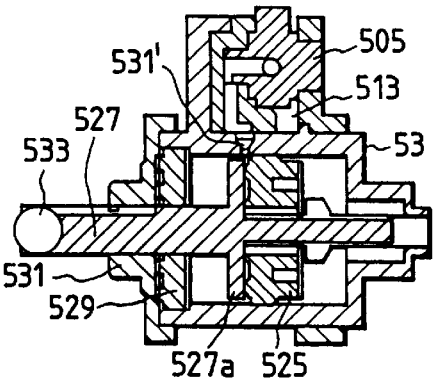

FIG. 15E indicates a condition when the intermediate idle suction is finished. It should be noted that, in this condition, the piston 525 is stopped immediately after it has passed through the communication opening 531'. If the piston goes to the lower dead point (FIG. 15A), when the piston returns to the upper dead point (FIG. 15B) or to the prepare position for idle suction (FIG. 15D), the time period when the communication opening 531' is not closed by the piston will be increased. In this case, in order to prevent the positive pressure from generating in the left chamber of the piston, it is so designed that a slight clearance is created between the flange portion 527*a* of the piston shaft and the piston 525 to communicate the left chamber with the right chamber of the piston 525. However, since the slight positive pressure is created due to the presence of grease and the like in the flow path, it is feared that the back flow of pressurized air occurs.

In the illustrated embodiment, such back flow will be generated in the case where the positive pressure is created in the right chamber of the pump when the piston 525 is shifted while opening the communication opening 531', for example, in the case where the piston 525 shifts from the upper dead point (FIG. 15B) to the prepare position for idle suction (FIG. 15D). Further, the back flow will be also generated in the case where the positive pressure is created in the left chamber of the pump when the piston 525 is shifted while opening the communication opening 531', for example, in the case where the piston 525 shifts from the lower dead point (FIG. 15A) to the prepare position for idle suction (FIG. 15D). Thus, the control of the relative position between the recording head and the ink receiving member which is preferable as an additional arrangement of this embodiment may be effected at least when the piston is returned after the suction operation or when the piston is reversed during the reciprocal movement thereof.

Figures 16, 16A:
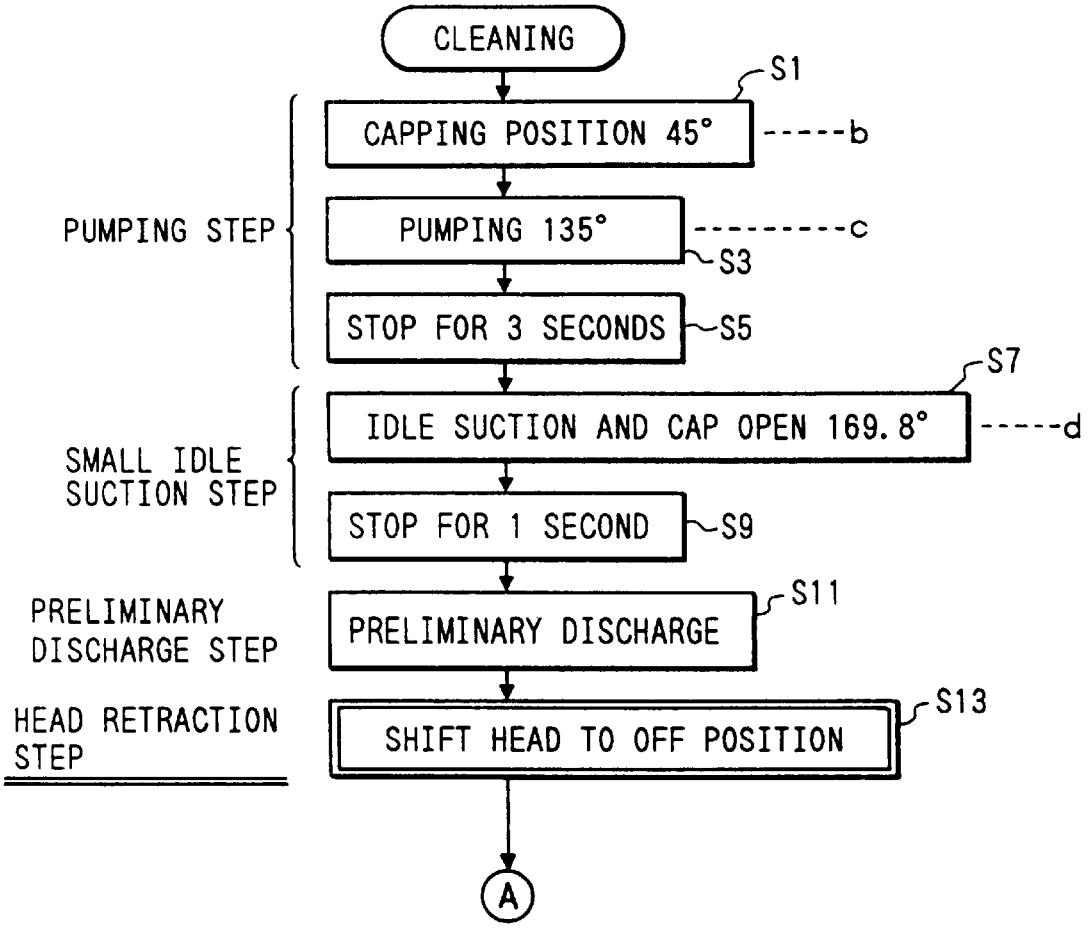
FIG. 16 is a flow chart showing an example of a cleaning sequence in a discharge recovery treatment according to this embodiment.
Figure 16B:
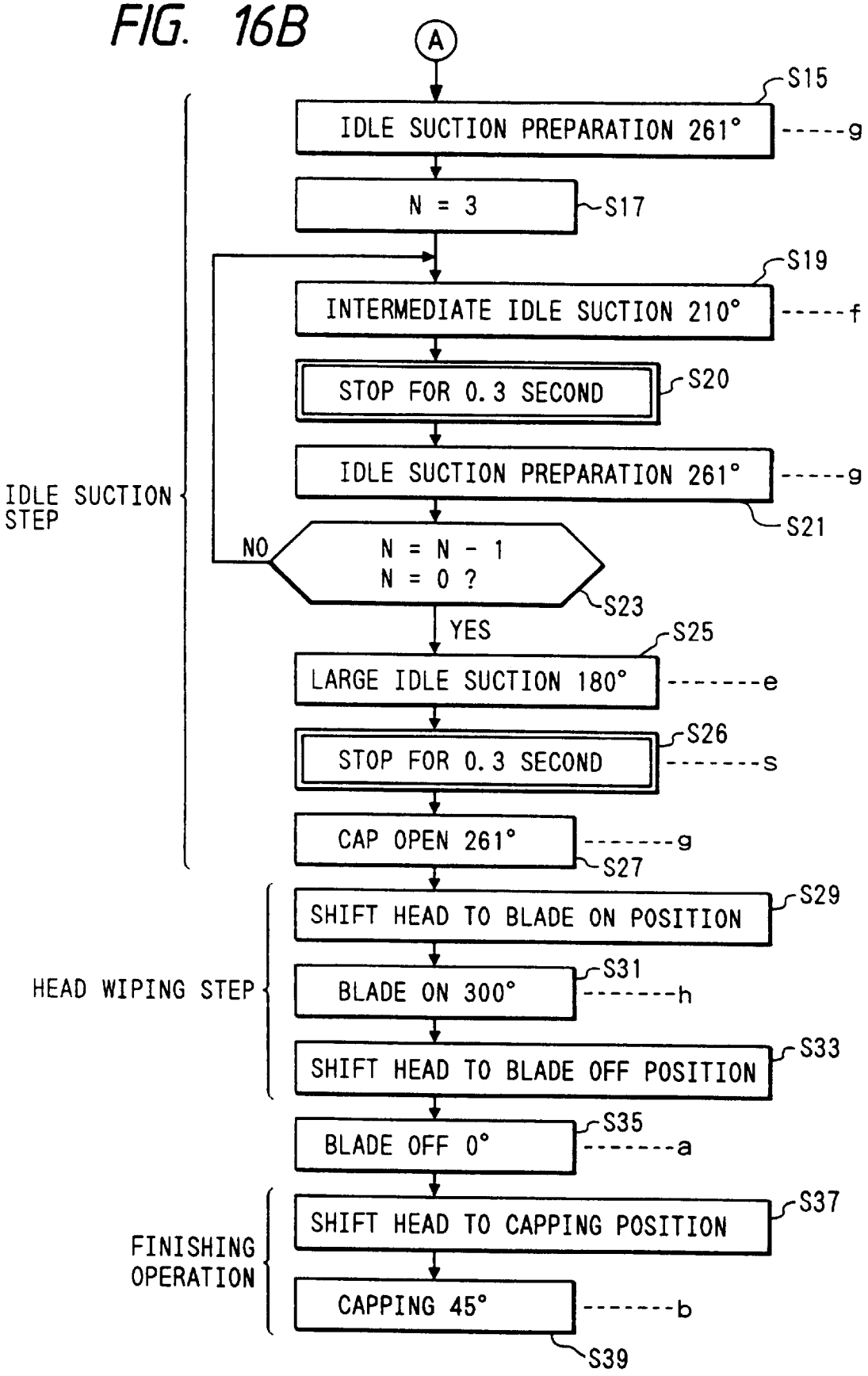

The flow chart of FIG. 16 shows an example of a sequence of the discharge recovery treatment executed by the recovery unit under the control of the MPU 1000.

First of all, the sequence is started from the condition b shown in FIG. 14 (capping condition) (step S1). When the condition c (stop position) is reached, the pumping is effected (step S3), and the stop for 3 seconds is effected at that condition for sucking the ink sufficiently (step S5). In the condition d, the cap is opened and at the same time the small idle suction is effected (step S7), and the stop for 1 second is effected to adequately suck the ink from the cap 51 and the cap lever 505 (step S9). Then, after the preliminary discharge (step S11), the recording head is shifted to the blade OFF position of FIG. 10 before the idle suction (step S13). As a result, the cap is moved to a position where it is not opposed to the recording head.

Then, the idle suction is effected to discharge the ink filled in the pump 53. First of all, the prepare position for idle suction g is reached (step S15), and then the shift between this condition and the condition stop position for intermediate idle suction f including the stop period s for 0.3 second (step S20) is reciprocally repeated by three times (steps S17–S23). Incidentally, the inversion of the prepare position g for idle suction is immediately effected without any stop period.

Then, by shifting the recording head from the prepare position g for idle suction to the stop position e for large idle suction (step S25) and at the same time by effecting the stop s for 0.3 second (step S26), the large idle suction is effected, thus expelling the ink in the pump 53 toward the waste ink tank adequately. Then, the recording head is shifted to the condition g (step S27), thus shifting the recording head to the blade ON position (step S29). And, by turning the blade ON at the position h (step S31) and by shifting the recording head to the blade OFF position, the wiping is effected (step S33). At last, at the position a, the blade is turned OFF (step S35), the recording head is returned to the capping position (step S37), and the capping is effected at the position b (step S39).

Figures 1, 17A:
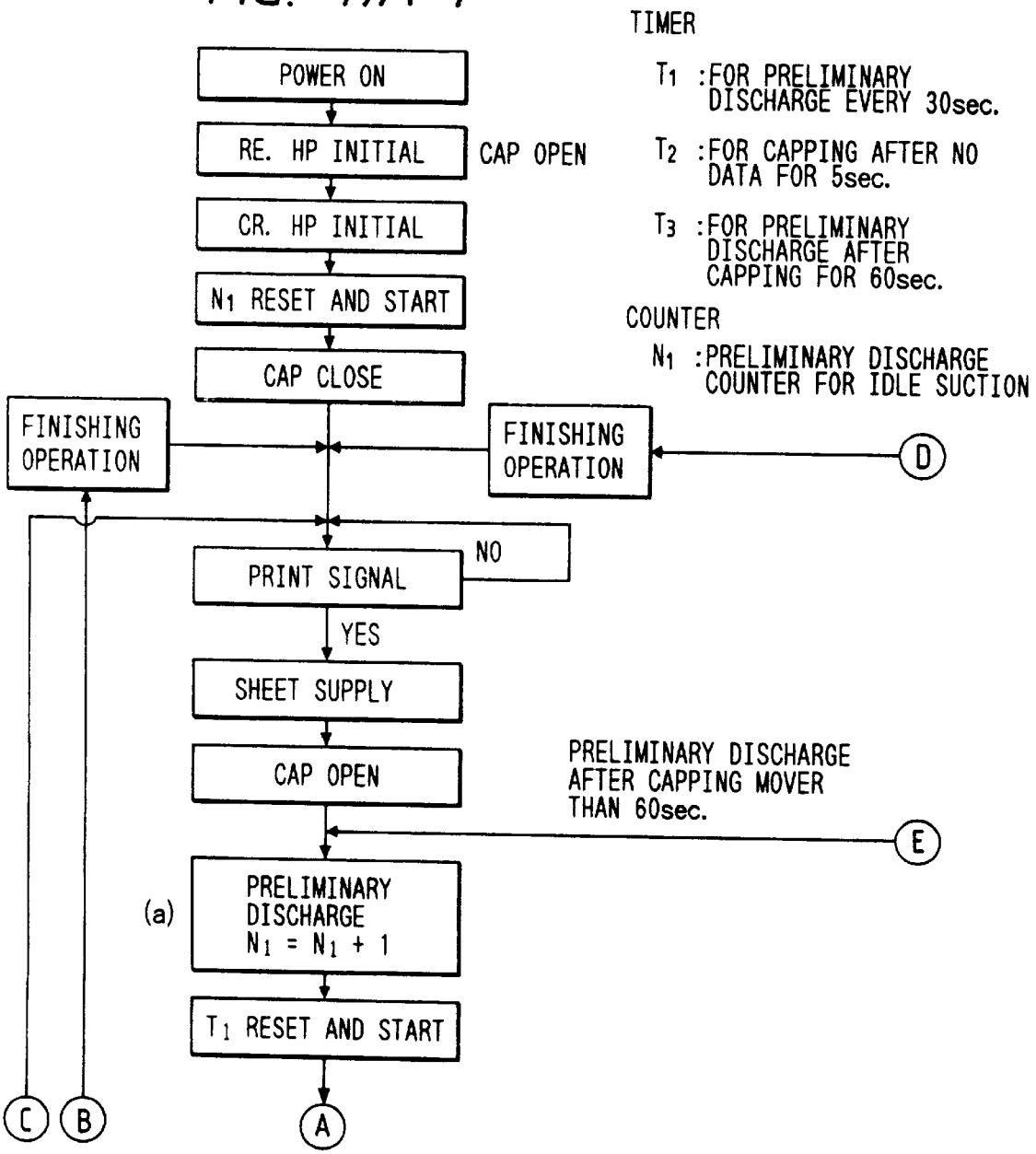
FIGS. 17A and 17B are flow charts including a recording operation according to this embodiment.
Figures 2, 17A:
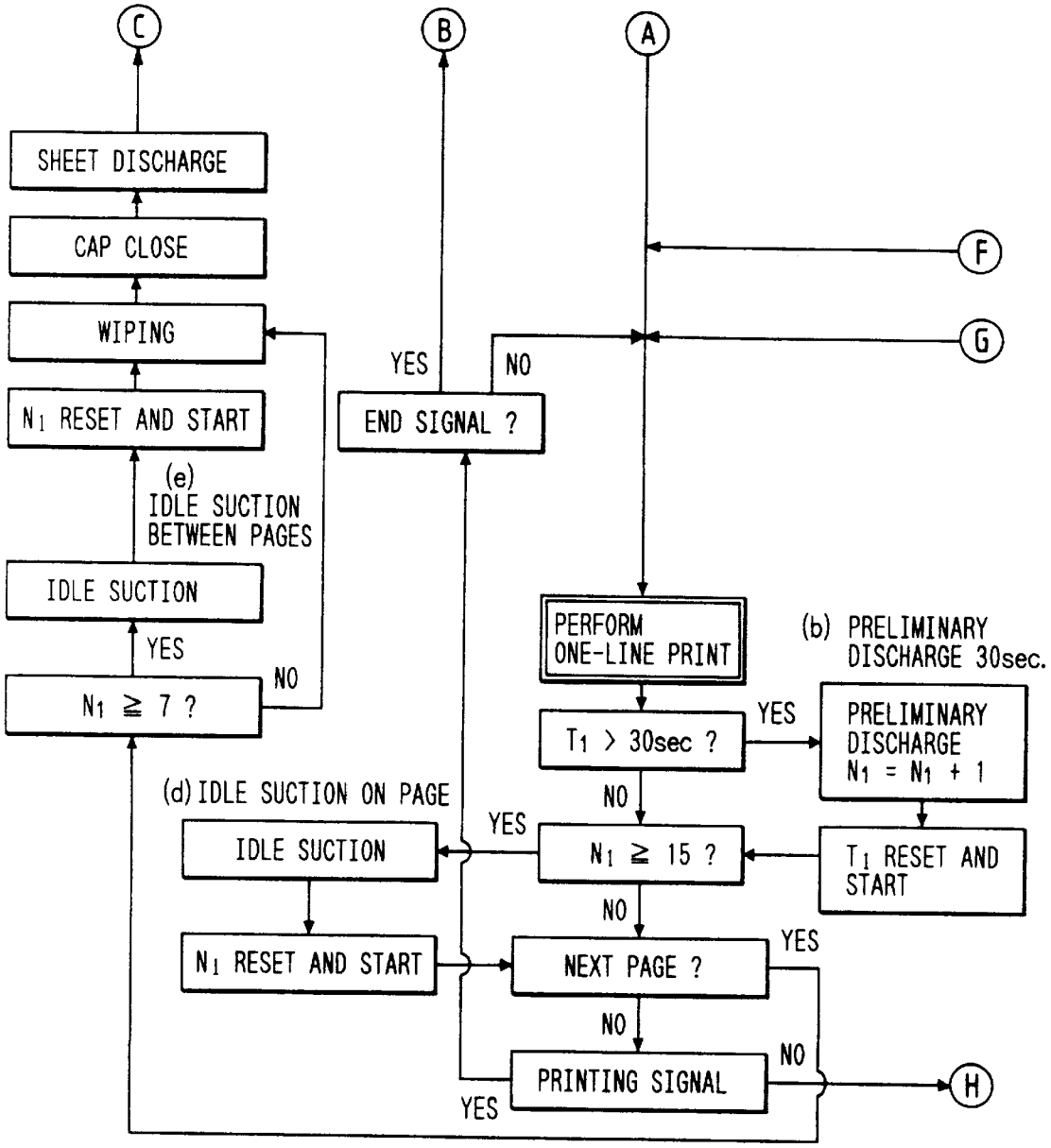
Figures 3, 17A:
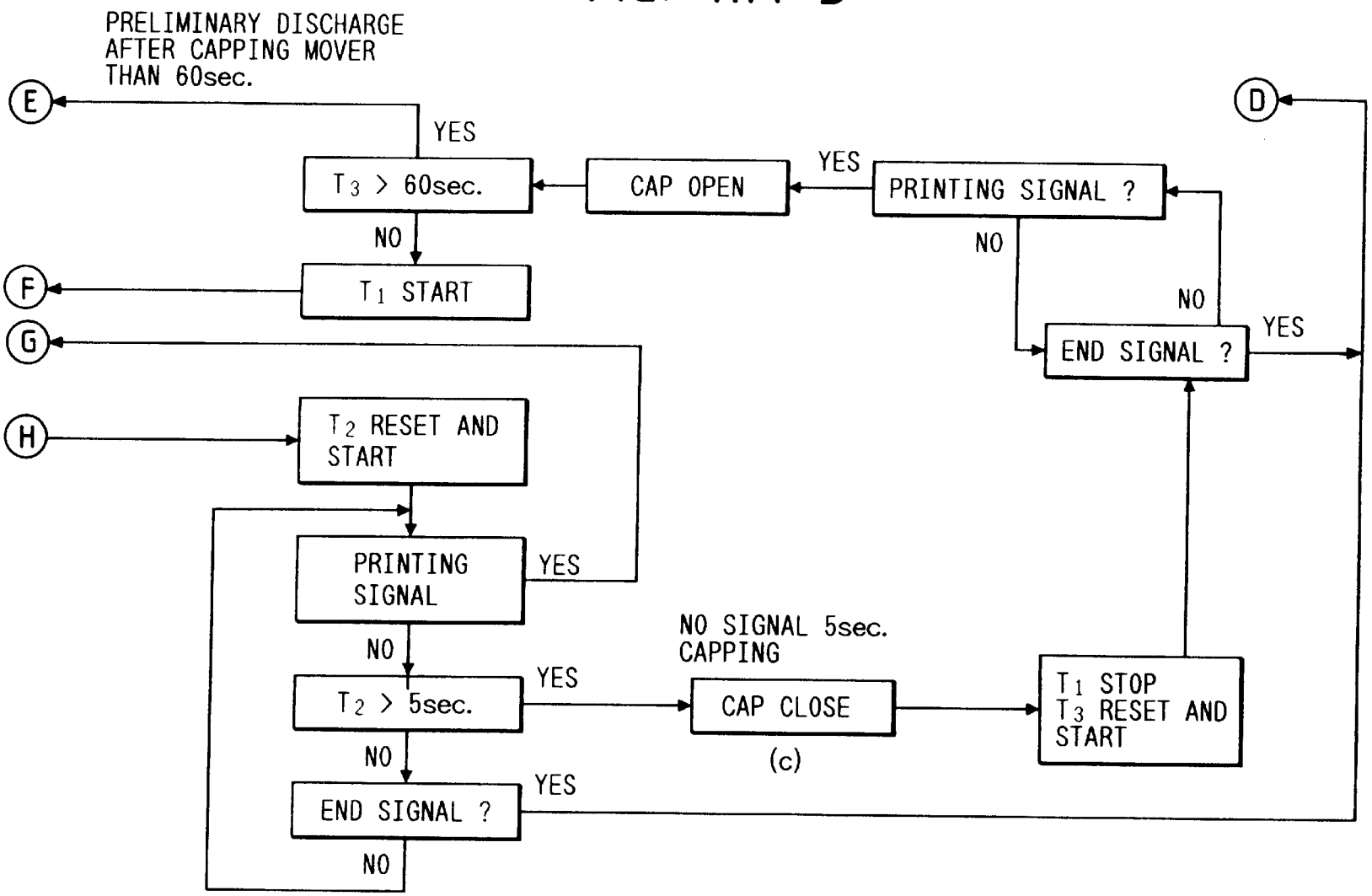
Figure 17B:
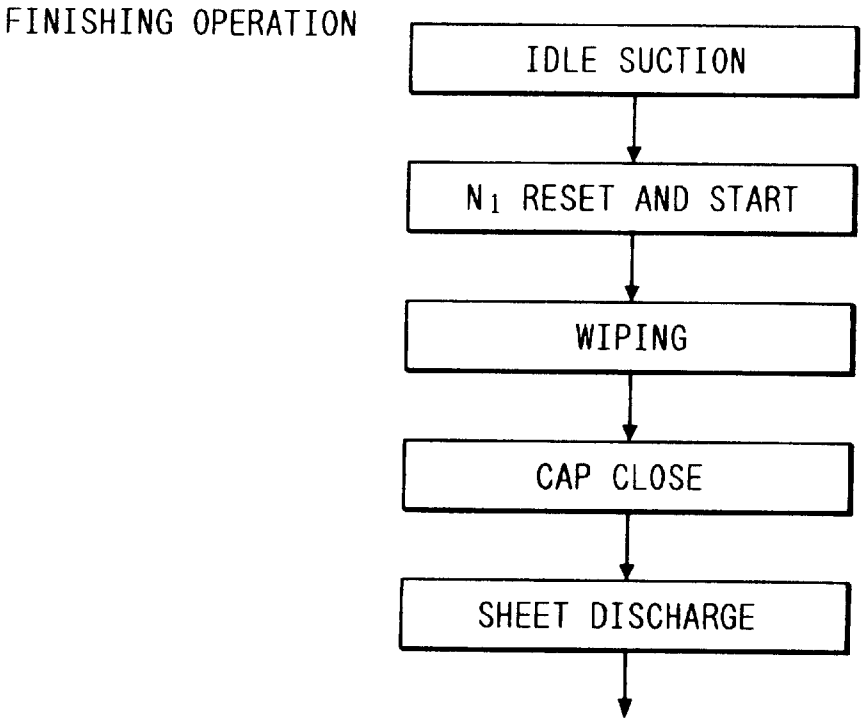

FIGS. 17A and 17B show flow charts for explaining a recording control sequence according to this embodiment. A main operation therein includes a preliminary discharge. Incidentally, FIG. 17B is a flow chart for executing the idle suction in the flow chart of FIG. 13.

The preliminary discharge (a) is effected immediately before the printing operation, and therefore, the preliminary discharges (b) are effected every for 30 second interval. The summing of such 30 second intervals can be achieved by a timer $T_1$. Since the timer $T_1$ is stopped when no signal 5 second capping (c) is effected, the time spent during the capping is not added to the 30 second time intervals. Further, when the capping (c) is continued more than 60 seconds, the control sequence is returned to the preliminary discharge (a) to perform the preliminary discharge after the cap has been opened and before the printing is effected. Since the preliminary discharge is performed within the cap, when the preliminary discharges are repeatedly performed, the ink will be increased in the cap. Accordingly, it is necessary to perform the idle suction for discharging the ink filled in the cap toward the waste ink tank. Fundamentally, the idle discharge is performed between one page printing and the next one page printing (during no printing operation). When the value in a preliminary discharge counter $N_1$ becomes 7 or more, the idle discharge (d) is performed. However, when the value in the counter $N_1$ becomes 15 or more during the one page printing, i.e., when the document requiring a long printing time is printed, the idle suction (e) is performed. Further, the idle suction is performed without fail after the printing operation is finished. Thereafter, a cleaning (wiping) operation for the surface of the recording head wetted by the ink after the printing operation is performed whenever one page printing and all page printing are finished.

The illustrated embodiment relates to a suction discharge recovery device having a suction pump including a piston therein and performing an idle suction to discharge the sucked ink from the suction pump, thereby preventing the back flow of the ink and wherein a stop period is provided at an inversion position near a lower dead point of the piston for performing the idle suction.

According to the illustrated embodiment, by providing the stop period near the lower dead point after the suction of the liquid, since the sucked liquid and the liquid being sucked are surely guided toward the discharging direction, it is possible to reduce an amount of the residual liquid remaining in the pump, which may cause the back flow of the liquid. Further, in a recording system incorporating a suction recovery device capable of making the suction recovery device itself small-sized and preventing the reduction in the efficiency of the device, since the installation space for the recovery device in the recording system itself can be greatly reduced, it is possible to reduce the whole dimension of the recording system and to enhance the reliability of the recording by means of the recording head.

Further, in a pump which does not use any valve mechanism for preventing the back flow of the ink and has a liquid suction opening within a moving range of a piston and wherein an elastic sliding portion is provided in the piston and a liquid discharge passage is defined by a clearance between the elastic portion and a piston shaft, since use of such pump depends upon the solving of the back flow problem, it is very effective.

By setting the starting position for the idle suction between the upper dead point and the suction opening, preferably at a position toward the suction opening (more preferably, at a position in the vicinity of the suction opening) regarding the piston movement toward the lower dead point, in place of the setting at the upper dead point for the pump suction operation, it is possible to reduce the shifting amount of the piston up to the idle suction starting position to limit the shifting range of the piston leading to the back flow of the liquid, thus preventing the back flow of the liquid effectively.

Further, by repeating the idle suction operations by several times and by inverting the piston immediately without any stop period at the idle suction starting position, even if more or less back flow of the liquid occurs, it is possible to positively prevent or limit the back flow to a negligible extent. Accordingly, particularly, with this arrangement, the back flow of the liquid is limited to minimum extent, thus achieving the effective idle suction.

Further, in the above-mentioned idle suction mode, by performing the idle suction from the idle suction starting position wherein the lower dead point is used as the inversion position for the stop period, after the idle suction is effected from the idle suction starting position to the inversion position near the suction opening, it is possible to greatly reduce the residual amount of the liquid remaining in the pump, and thus, to eliminate the inconvenience due to the solidification of the liquid and to improve the condition in the suction path, thereby improving the subsequent suction recovery treatment.

According to the present invention, the industrial advantage that a pump having the minimum volume between the upper dead point and the lower dead point, and particularly, a volume of 1 cc or less (preferably, 0.1 cc or less) can be used is obtained.

The present invention provides a recording system which can stabilize the recording feature of a recording head using electrical/thermal converters (preferably, utilizing the film boiling technique) for a long time, can enhance the advantage of this recording head and can provide the stable recording feature.

In order to further enhance the above-mentioned advantages, by adopting an arrangement wherein the conventional upper dead point is omitted and the idle suction starting position itself is used as an upper dead point, that is to say, by closing at least a portion of the suction opening by the piston immediately after the piston is shifted toward the lower dead point, it is possible to greatly eliminate the cause for the back flow of the liquid. In this case, the residual amount of the liquid can be further reduced. In addition, with this arrangement, by opposing the sealing portion of the piston to at least a portion of the suction opening at the idle suction starting position, the back flow problem can be solved surely.

Incidentally, in the above-mentioned embodiment, it is preferable that a means is provided for keeping a condition that the recording head is not disposed in confronting relation to the cap during the idle suction mode in order to cope with a case where if the back flow should occur during the idle suction due to the vibration acting on the recording head.

By the way, the other factor for causing the back flow of the ink can be considered as folllows:

In the condition shown in FIG. 9B, as mentioned above, the suction opening or communication opening 531' is not closed by the piston 525 to establish the communication between the suction opening and the atmosphere (i.e., space B). Since the space B is always communicated with the waste ink tank side, generally, the pressure is not increased. However, practically, in the actual recording system, the ink passage to the waste ink tank is very narrow because of the space savings. Thus, when the piston is shifted to the lower dead point for a relatively short time, the pressure in the space B will be somewhat increased. As a result, if the suction opening 531' is communicated with the space B for a long time, the positive pressure will be transmitted to the cap until the suction opening 531' is completely closed by the piston 525, thus causing the back flow of the ink.

The following embodiment can solve this problem.

Figure 18:
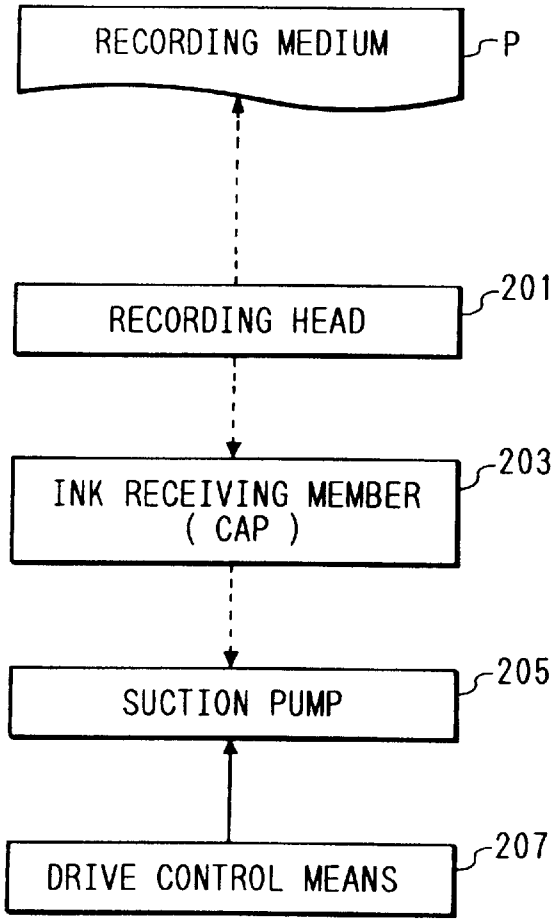
FIG. 18 is a schematic block diagram showing the whole construction of an ink jet recording system according to a further embodiment of the present invention.

FIG. 18 is a block diagram showing the schematic whole construction of an ink jet recording system according to this embodiment.

The recording system comprises a recording head 201 for discharging liquid (ink) toward a recording sheet P, an ink receiving member 203 for receiving the ink discharged from the recording head 201, a suction pump 205 for sucking the ink received by the ink receiving member 203, and a drive control means 207 for controlling the activation of the suction pump 205. The construction of the suction pump 205 and the drive control of the drive control means 207 for the suction pump 205 are the same as the aforementioned ones. In FIG. 18, the broken arrows indicate the flow of the ink, and the solid arrow indicates the control for the suction pump 205 effected by the drive control means 207.

According to this embodiment, by selecting the positional relation between the shape of the piston and the position of the suction opening (communication opening) in such a manner that the suction opening is opened even when the piston is at its upper dead point and the suction opening is closed at the same time or immediately after the piston is shifted toward the lower dead point, it is possible to perform such control that during the idle suction operation the suction opening is closed, for example, when the piston is slightly shifted from the upper dead point toward the lower dead point, and the negative pressure is generated by driving the piston from this condition. As a result, it is possible to greatly reduce the back flow of the ink, liquid and/or air once sucked through the suction opening during the idle suction operation.

Now, the above-mentioned embodiment will be fully explained with reference to the drawings.

FIGS. 19A–19E show a schematic section of the suction pump according to this embodiment.

Figure 19A:
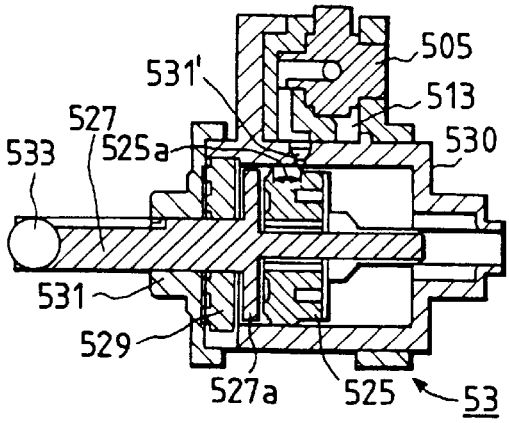
FIGS. 19A to 19C are sectional views for explaining operating stages of a suction pump used in a discharge recovery device according to this embodiment.

FIG. 19A shows a condition that the piston 525 is at its upper dead point. In this condition, the suction opening 531' is opened as similar to the example shown in FIG. 9A. However, in this embodiment, the relation between the axial length of the peripheral surface of the piston 525 and the position of the suction opening 531' is so selected that the suction opening 531' starts to be closed when the piston 525 is shifted from this condition toward the lower dead point. In other words, the area of the peripheral surface of the piston contacting with the inner peripheral surface of the cylinder is disposed adjacent to the suction opening when the piston is at the upper dead point. Incidentally, when the piston is at the upper dead point, the suction opening may be partially closed by the piston. Further, the positional relation between the piston and the suction opening is not limited to the above-mentioned positional relation, but, any positional relation may be selected so long as the suction opening is not closed when the piston is at its upper dead point and the suction opening starts to be closed at the same time or immediately after the piston is shifted toward the lower dead point. With such arrangements, it is possible to reduce to a minimum extent a timer period when the suction opening is being communicated with the space B during the shifting movement of the piston toward the lower dead point, thus limiting the occurrence of the back flow to a minimum extent.

Figure 19B:
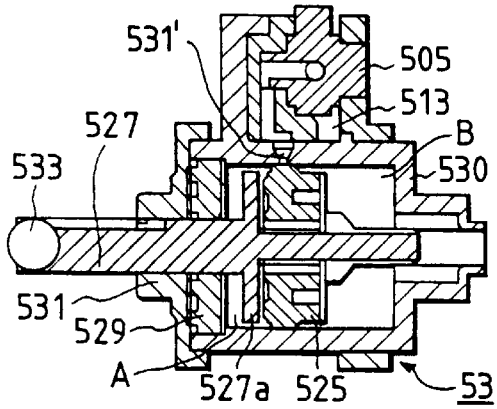
Figure 19C:
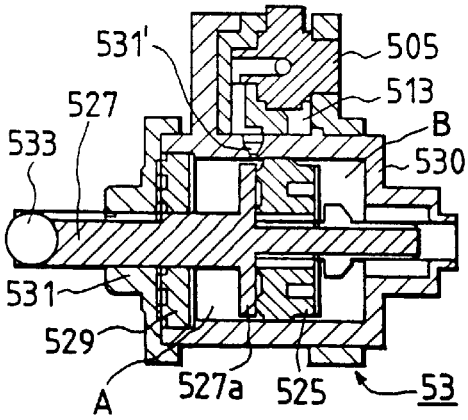

FIG. 19B shows a condition when the piston 525 is slightly shifted from the piston shown in FIG. 19A toward the lower dead point. In this condition, the suction opening 531' is completely closed. FIG. 19C shows a stop position after pumping. In this position, the suction opening 531' is opened as similar to the example shown in FIG. 9C.

On the basis of the above-mentioned arrangement, when the idle suction is performed by reciprocally shifting the piston between the positions shown in FIGS. 19A and 19C, it is possible to achieve the idle suction operation with the minimum back flow of the ink and the like. That is to say, in the condition that the piston 525 is at its upper dead point as shown in FIG. 19A, the relation between the axial length of the peripheral surface of the piston 525 and the position of the suction opening 531' is so selected that a width 525*a* of the area of the peripheral surface of the piston contacting with the inner peripheral surface of the cylinder 530 becomes maximum within the range that the suction opening 531' is not closed by the peripheral surface of the piston 525. With this arrangement, when the piston is reciprocally shifted between the positions shown in FIGS. 19A and 19C, since the suction opening 531' is closed with respect to the space B as the piston 525 is firstly shifted from the position shown in FIG. 19A to the position shown in FIG. 19C, even if the pressure in the space B is increased, the back flow of the ink is prevented. Further, since the contact length 525*a* of the piston surface is selected to be the maximum according to the position of the suction opening 531', it is possible to make the stroke from the position of FIG. 19A to the position of FIG. 19C greater, thus obtaining the greater suction pressure and suction amount during the idle suction.

Further, when the piston 525 is shifted from the position of FIG. 19C to the position of FIG. 19A, the pressure in the space A is slightly increased, which may cause the back flow. However, by selecting the position of the piston in the condition of FIG. 19C so that the suction opening 531' is closed as the piston 525 is slightly shifted toward the upper dead point, such back flow can be prevented.

Incidentally, the above-mentioned contacting width between the peripheral surface of the piston and the inner surface of the cylinder is not limited to the above example. That is, for example, when two annular ridges are formed on the peripheral surface of the piston at both ends thereof and these ridges are contacted with the cylinder surface, the contacting width may be defined by a distance between the two ridges.

Figure 20:
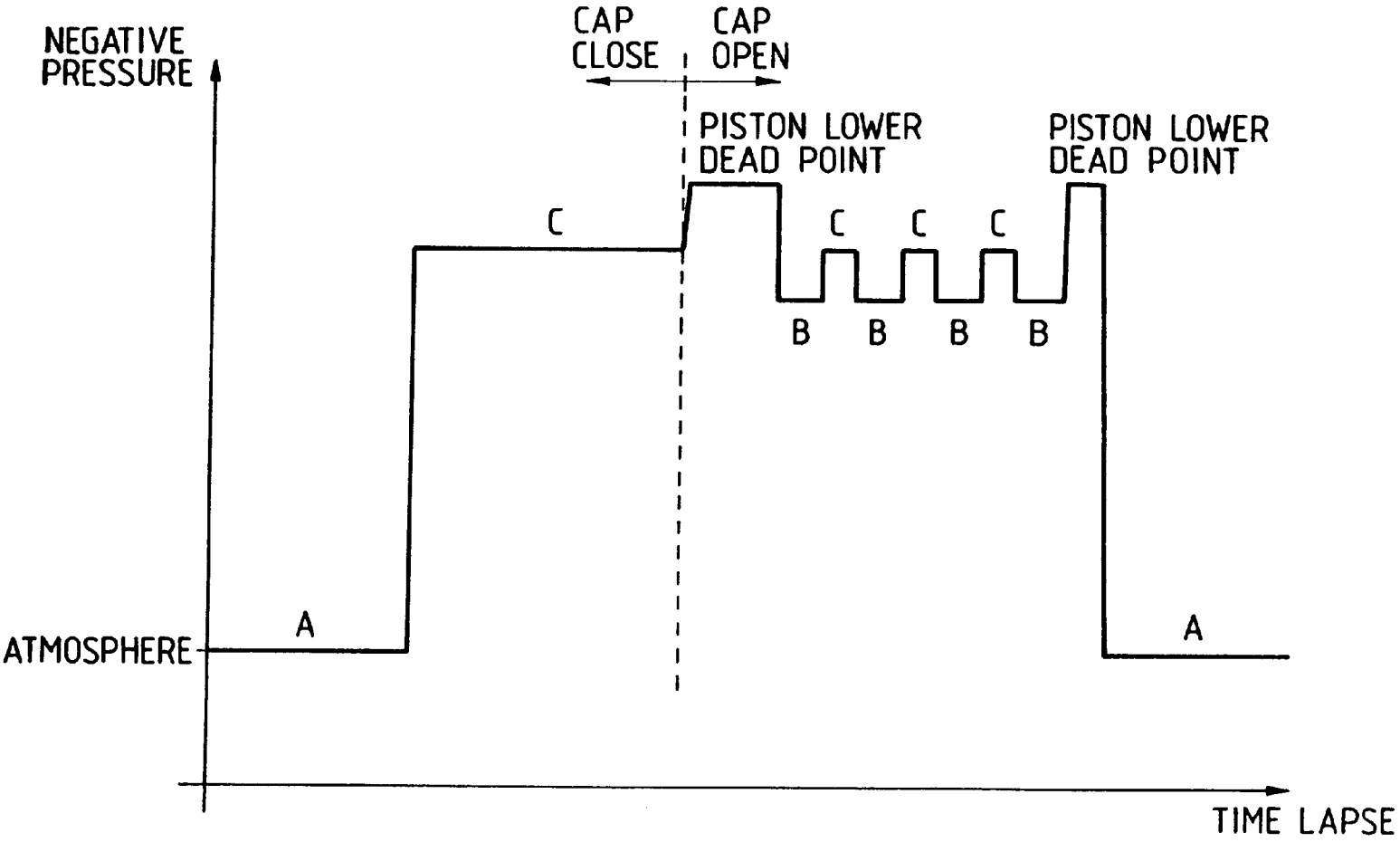
FIG. 20 is a graph showing the change in pressure during a recovery operation of the suction pump.

FIG. 20 is a graph showing the change in pressure during the recovery operation effected by the discharge recovery device using the above pump.

In FIG. 20, the change in the pressure in portions wherein the idle suction is effected, i.e., the change in the pressure while the piston is reciprocated between conditions B and C where the suction opening is closed represents the characteristic of this embodiment most clearly. Although the great negative pressure is generated in the condition C or a condition that the piston reaches the lower dead point, since the suction opening 531' is immediately closed as the piston returns from the these conditions to be condition B and the suction opening is also closed even in the condition B, the negative pressure does not decrease below a certain value.

Incidentally, in the above embodiment (refer to FIG. 2), while the drive controls of the idle suction operation were performed by three times and once, the present invention is not limited to such numbers of controls.

Further, in the above embodiment, while an example that the final position of the piston in the idle suction operation corresponds to the position shown in FIG. 19C was explained, the present invention is not limited to this example.

Further, in the above embodiment, while an example that the idle suction of the discharge recovery device is applied was explained, the present invention is not limited to this example; but, for example, the suction pump can be used for sucking the ink from the ink receiving member for receiving the ink discharged by the idle discharge operation.

Incidentally, the present invention gives excellent advantages when it is applied to an ink jet recording system of the type wherein a recording head discharges ink from its discharge openings by utilizing thermal energy and has electrical/thermal converters for generating the thermal energy to be supplied to the ink, and, particularly, to an ink jet recording system of the type wherein a recording head discharges ink from its discharge openings by growing a bubble by the film boiling generated by the thermal energy supplied by electrical/thermal converters. In the recording systems wherein the recording head has the electrical/thermal converters for generating the thermal energy to be supplied to the ink or the electrical/thermal converters for generating the thermal energy for causing film boiling in the ink, since the waste ink discharged from the recording head by the discharge recovery treatment has sometimes high viscosity and includes dirt and the like, if the waste ink is scattered from the cap and is adhered to the recording head due to the back flow, the discharge openings of the recording head are likely to be jammed by the adhered ink. Thus, the present invention is very effective to such recording system.

Preferably, the typical construction and principle of the recording head and recording system wherein the ink is discharged by the thermal energy can be realized by using the fundamental principles, for example, disclosed in U.S. Pat. Nos. 4,723,129 and 4,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding nucleate boiling to the electrical/thermal converting elements arranged in correspondence to the paper or liquid passages including the liquid (ink) therein, it is possible, to form a bubble in the liquid (ink) in corresponding to the drive signal by generating film boiling on the heat acting surface of the recording head due to the generation of the thermal energy in the electrical/thermal converting elements. Due to the growth and contaction of the bubble, the liquid (ink) is discharged from the discharge opening to form at least one ink droplet. When the drive signal has a pulse shape, since the growth and contraction of the bubble can be quickly effected, more excellent ink discharge is achieved. Such pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention, includes the construction wherein the heat acting portion is disposed in an arcuate area as disclosed in U.S. Pat. Nos. 4,558,333 and 4,459,600, as well as the constructions wherein the discharge openings, liquid paths and electrical/thermal converting elements are combined (straight liquid paths or orthogonal liquid paths). In addition, the present invention can applicable to the construction wherein each discharge opening is constituted by a slit with which a plurality of electrical/thermal converting elements associated in common as disclosed in the Japanese Laid-Open Application No. 59-123670 and the construction wherein openings for absorbing the pressure wave of the thermal energy are arranged in correspondence to the discharge openings as disclosed in the Japanese Laid-Open Application No. 59-138461.

Further, the present invention can be applied to a recording head of full-line type having a length corresponding to a maximum width of a recording medium to be recorded, as such recording head, and the construction wherein such length is attained by combining a plurality of recording heads as disclosed in the above U.S. patents or a single recording head integrally formed may be adopted.

In addition, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, it is preferable that a head recovery means and an auxiliary aiding means are added to the recording system according to the present invention, since the effect of the present invention is further improved. More particularly, these means include a capping means, cleaning means, pressurizing or suction means, and an auxiliary heating means comprising electrical/thermal converters or other heating elements or the combination thereof. Further, it is effective for the stable recording to perform a preliminary discharge mode for effecting the ink discharge regardless of the recording ink discharge.

Further, as the recording mode of the recording system, the present invention can effectively be applied not only to a recording mode with a single main color such as black, but also to a system providing a plurality of different colors and/or a full-color by mixing colors by using an integrated recording head or the combination of plural recording heads.

Further, in the illustrated embodiments, while the ink was liquid, the ink may be solid in a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention. In such a case, the ink can be held in the liquid state or solid state in recesses or holes in porous sheet as disclosed in the Japanese Laid-Open Application Nos. 54-56847 and 60-71260, in confronting relation to the electrical/thermal converters. Incidentally, in the present invention the above-mentioned film boiling principle is most effective for each ink.

What is claimed is:

1. An ink jet apparatus comprising:

sucking means for sucking an ink from a cap, said sucking means including a sucking space formed by a cylinder and a piston adapted to said cylinder, a movement of the piston in the cylinder being characterized by a piston stroke, wherein an internal pressure variation in said sucking space varies corresponding to a mutual relation of said cylinder and said piston, said sucking means having a suction opening for transmitting the internal pressure variation in said sucking space to a cap for covering an ink discharge opening of a recording head; and controlling means for controlling said sucking means so that a length of a stroke of the piston in the cylinder during an idle suction, when the suction is performed in a state where the cap is opened to atmosphere, is smaller than a length of a stroke of the piston in the cylinder during a true suction, when the suction is performed in a state where the cap is closed to the atmosphere, and the idle suction starts from a start point in which said piston and said cylinder are disposed relative to each other such that said piston shuts said suction opening at a same time or immediately after a start of the idle suction and advances toward a lower dead point of said cylinder, wherein the internal pressure variation in said sucking space is transmitted to the cap during the piston stroke of idle suction, and wherein the internal pressure variation transmitted to the cap during the piston stroke of idle suction is less than the internal pressure variation in said sucking space transmitted to the cap in true suction.

2. An ink jet apparatus according to claim 1, wherein said piston has an elastic sliding contact portion and a liquid discharge path is defined by a clearance space provided between said elastic sliding contact portion and a piston shaft.

3. An ink jet apparatus according to claim 2, wherein the idle suction is performed when said piston is shifted from an idle suction starting position between an upper dead point of said piston and said suction opening toward the lower dead point.

4. An ink jet apparatus according to claim 3, wherein an inversion position of said piston during the idle suction is defined by a position near said suction opening after said piston has passed said suction opening.

5. An ink jet apparatus according to claim 4, wherein the idle suction is performed by shifting said piston up to said inversion position near said suction opening several times, and the inversion at said idle suction starting position occurs without a stop period.

6. An ink jet apparatus according to claim 5, wherein the idle suction is performed by shifting said piston from said idle suction starting position to said lower dead point after said piston is shifted from said idle suction starting position to said inversion position near said suction opening.

7. A recovery method of an ink jet apparatus having a sucking means for sucking an ink from a cap, said sucking means including a sucking space formed by a cylinder and a piston adapted to said cylinder, a movement of the piston in the cylinder being characterized by a piston stroke, wherein an internal pressure variation in said sucking space varies corresponding to a mutual relation of said cylinder and said piston, said sucking means having a suction opening for transmitting the internal pressure variation in said sucking space to a cap for covering an ink discharge opening of a recording head, the method comprising steps of:

setting a length of a stroke of the piston in the cylinder during an idle suction, when the suction is performed in a state where the cap is open to the atmosphere, smaller than a length of a stroke of the piston in the cylinder during a true suction, when the suction is performed in a state where the cap is closed to the atmosphere, wherein the internal pressure variation in said sucking space is transmitted to the cap during the piston stroke of idle suction, and wherein the internal pressure variation in said sucking space transmitted to the cap during the stroke of the piston in idle suction is less than the internal pressure variation in said sucking space transmitted to the cap in true suction;

starting an idle suction from a start point between said piston and said cylinder where said piston shuts the suction opening at a same time or immediately after a start of the idle suction; and advancing said piston toward a lower dead point of said cylinder.

8. A method according to claim 7, wherein said piston has an elastic sliding contact portion and a liquid discharge path is defined by a clearance space provided between said elastic sliding contact portion and a piston shaft.

9. A method according to claim 8, wherein the idle sucking is performed when said piston is shifted from an idle sucking starting position between an upper dead point of said piston and said suction opening toward the lower dead point.

10. A method according to claim 9, wherein an inversion position of said piston during the idle sucking is defined by a position near said suction opening after said piston has passed said suction opening.

11. A method according to claim 10, wherein the idle sucking is performed by shifting said piston up to said inversion position near said suction opening several times, and the inversion at said idle sucking starting position occurs without a stop period.

12. A method according to claim 11, wherein the idle sucking is performed by shifting said piston from said idle sucking starting position to said lower dead point after said piston is shifted from said idle sucking starting position to said inversion position near said suction opening.

13. A recovery method for an ink jet recording apparatus having sucking means for performing suction from a plurality of ink discharge openings of an ink jet head via a cap for covering the ink discharge openings, said sucking means including a sucking space defined by a cylinder and a piston adapted to said cylinder, comprising the steps of:

performing a true sucking by the sucking means when an inside of the cap is closed to atmosphere; and performing an idle sucking by the sucking means when the inside of the cap is communicated with the atmosphere, wherein a length of a stroke of the piston in the cylinder is shorter in said idle sucking step than in said true sucking step, and wherein the amount of pressure change transmitted to the cap by the sucking means during one stroke of the sucking means in said idle sucking step is less than an amount of pressure change transmitted to the cap in said true sucking step.

14. An ink jet recording apparatus, comprising:

a cap for covering an ink discharge opening of an ink jet head;

sucking means for performing a sucking from the ink discharge opening through said cap, said sucking means including a sucking space formed by a cylinder and a piston adapted to said cylinder; and operating means for operating said sucking means;

wherein said operating means operates said sucking means to perform true sucking, wherein an inside of said cap is closed to atmosphere, and operates said sucking means to perform idle sucking, wherein the inside of said cap is communicated with the atmosphere, and wherein a length of a stroke of the piston in the cylinder is shorter in said idle sucking than in said true sucking.

15. A suction pump used to process ink expelled from a recording head, said suction pump comprising:

a cylinder contactable with the recording head and having a suction port communicated with a cap formed of an elastic material through a flow path member to suck ink expelled from said recording head toward said cap; and a piston for performing an operation to generate a negative pressure for the suction, the piston contacting an inner wall of said cylinder for opening or closing said suction port in response to the operation, wherein said suction port and said piston are positioned so that said suction port is communicated with an interior of said cylinder when said piston is at an upper dead center and a size of an opening area of said suction port begins to reduce at a same time or immediately after said piston starts to move from the upper dead center to a bottom dead center.

16. A suction pump according to claim 15, wherein said suction port and said piston are positioned such that a portion of said piston in contact with the inner wall of said cylinder is adjacent to said suction port or covers a portion of said suction port when said piston is at the upper dead center.

17. An ink jet recording apparatus comprising:

a recording head;

a cap contactable with said recording head and formed of an elastic material, said cap receiving ink expelled from said recording head;

a suction pump for sucking the ink received by said cap, said pump having a cylinder having a suction port for sucking the expelled ink and a piston for performing an operation to generate a negative pressure for suction, the piston contacting an inner wall of said cylinder for opening or closing said suction port in response to the operation, said suction port and said piston positioned so that said suction port is communicated with an interior of said cylinder when said piston is at an upper dead center and a size of an opening area of said suction port begins to reduce at a same time or immediately after said piston starts to move from the upper dead center to a bottom dead center; and a flow path member for communicating said suction port of said suction pump with said cap.

18. A suction pump according to claim 17, wherein said recording head discharges ink through a discharge port by utilizing thermal energy and has an electothermal converting element for generating thermal energy applied to the ink.

19. A suction pump according to claim 18, wherein said recording head causes film boiling in the ink by utilizing thermal energy and discharges the ink upon growth of a bubble caused by the film boiling.

* * * * *

UNITED STATES PATENT AND TRADEMARK OFFICE

CERTIFICATE OF CORRECTION

PATENT NO. : 6,154,231
DATED : November 28, 2000
INVENTOR(S) : Iwata

It is certified that error appears in the above-identified patent and that said Letters Patent is hereby corrected as shown below:

Column 5,
Line 8, "an 2" should read -- 2 --.

Column 8,
Line 61, "the in 507" should read -- the pin 507 --.

Column 13,
Line 38, "for" should read -- far --.

Column 14,
Line 45, "this' should read -- thus --.

Column 15,
Line 45, "an encircled a" should read -- a --.

Column 18,
Line 13, "every for 30" should read -- for every 30 --.

Column 22,
Line 54, "corresponding" should read -- correspondence --: and
Line 63, "signal" should read -- signals --.

Column 23,
Line 8, "can" should read -- can be --; and
Line 11, "associated" should read -- are associated --.

UNITED STATES PATENT AND TRADEMARK OFFICE

CERTIFICATE OF CORRECTION

PATENT NO. : 6,154,231
DATED : November 28, 2000
INVENTOR(S) : Iwata

It is certified that error appears in the above-identified patent and that said Letters Patent is hereby corrected as shown below:

Signed and Sealed this

Thirteenth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,154,231
DATED : November 28, 2000
INVENTOR(S) : Iwata

It is certified that error appears in the above-identified patent and that said Letters Patent is hereby corrected as shown below:

Column 5,
Line 8, "an 2" should read -- 2 --.

Column 8,
Line 61, "the in 507" should read -- the pin 507 --.

Column 13,
Line 38, "for" should read -- far --.

Column 14,
Line 45, "this' should read -- thus --.

Column 15,
Line 45, "an encircled a" should read -- a --.

Column 18,
Line 13, "every for 30" should read -- for every 30 --.

Column 22,
Line 54, "corresponding" should read -- correspondence --: and
Line 63, "signal" should read -- signals --.

Column 23,
Line 8, "can" should read -- can be --; and
Line 11, "associated" should read -- are associated --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*